US005846139A

United States Patent [19]

Bair et al.

[11] Patent Number: 5,846,139

[45] Date of Patent: Dec. 8, 1998

[54] GOLF SIMULATOR

[75] Inventors: Carl J. Bair, 11475 Eastridge Pl., San Diego, Calif. 92131; Robbie J. Bair, San Diego; Leslie R. Corn, Santa Fe, both of Calif.

[73] Assignee: Carl J. Bair, San Diego, Calif.

[21] Appl. No.: 748,386

[22] Filed: Nov. 13, 1996

[51] Int. Cl.[6] ..... A63B 69/36

[52] U.S. Cl. ..... 473/156; 473/152; 473/222; 473/199; 473/409; 434/252

[58] Field of Search ..... 473/151–153, 473/156, 198, 199, 200, 409; 273/317.1–317.2, 358, 371; 434/252

[56] References Cited

U.S. PATENT DOCUMENTS

| | | | |
|---|---|---|---|
| 4,150,825 | 4/1979 | Wilson | 273/185 B |
| 5,333,874 | 8/1994 | Arnold et al. | 273/185 B |
| 5,390,927 | 2/1995 | Angelos | 473/156 |
| 5,481,355 | 1/1996 | Iijima et al. | 473/199 |
| 5,577,733 | 11/1996 | Downing | 273/371 |
| 5,626,526 | 5/1997 | Pao et al. | 473/152 |

*Primary Examiner*—Jessica J. Harrison
*Assistant Examiner*—Mark A. Sager
*Attorney, Agent, or Firm*—Brown, Martin, Haller & McClain, LLP

[57] ABSTRACT

A golf simulator has a housing and three arrays of IR receivers and emitters positioned in the housing. A launch area is established near one end of the housing, and a user can launch a golf ball located in the launch area and drive the ball into the housing through the planes defined by the arrays of emitters and against a screen positioned at one end of the housing. The planes established by the arrays are disposed vertically and perpendicular to the angle of travel of the ball. A computer is connected to the IR receivers, which detect the passage of the golf ball through each respective plane. Based upon the signals from the receivers the computer, using triangulation techniques, determines the horizontal and vertical position, as well as the velocity, of the ball for a range of shots including drives, steep chip shots and putts less than 4 feet. The computer can also determine the spin of the golf ball, and cause an image of the golf ball, as it would have appeared traveling away from the golfer had it not encountered the screen, to be displayed on the screen.

21 Claims, 13 Drawing Sheets

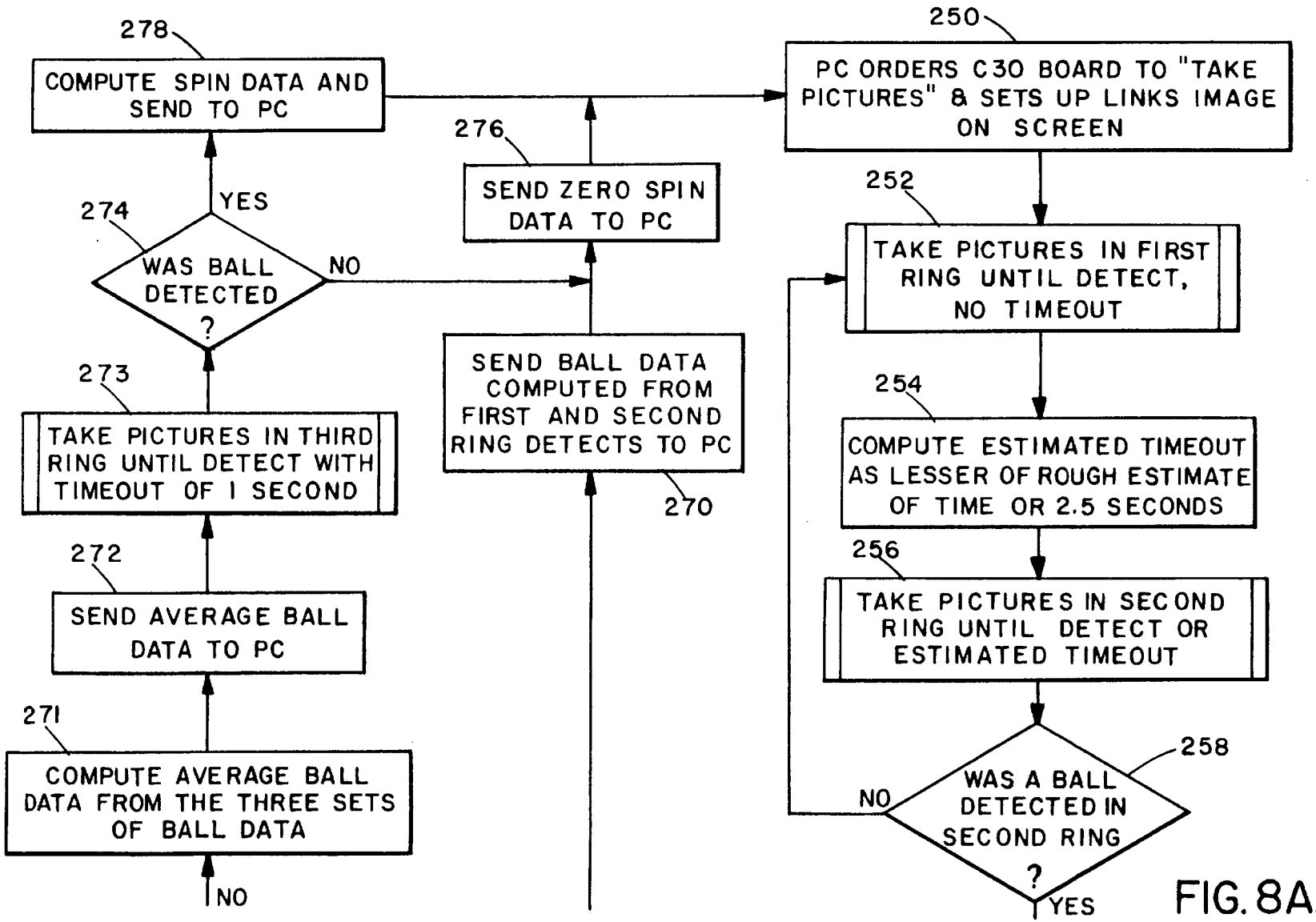
FIG. 8A/1

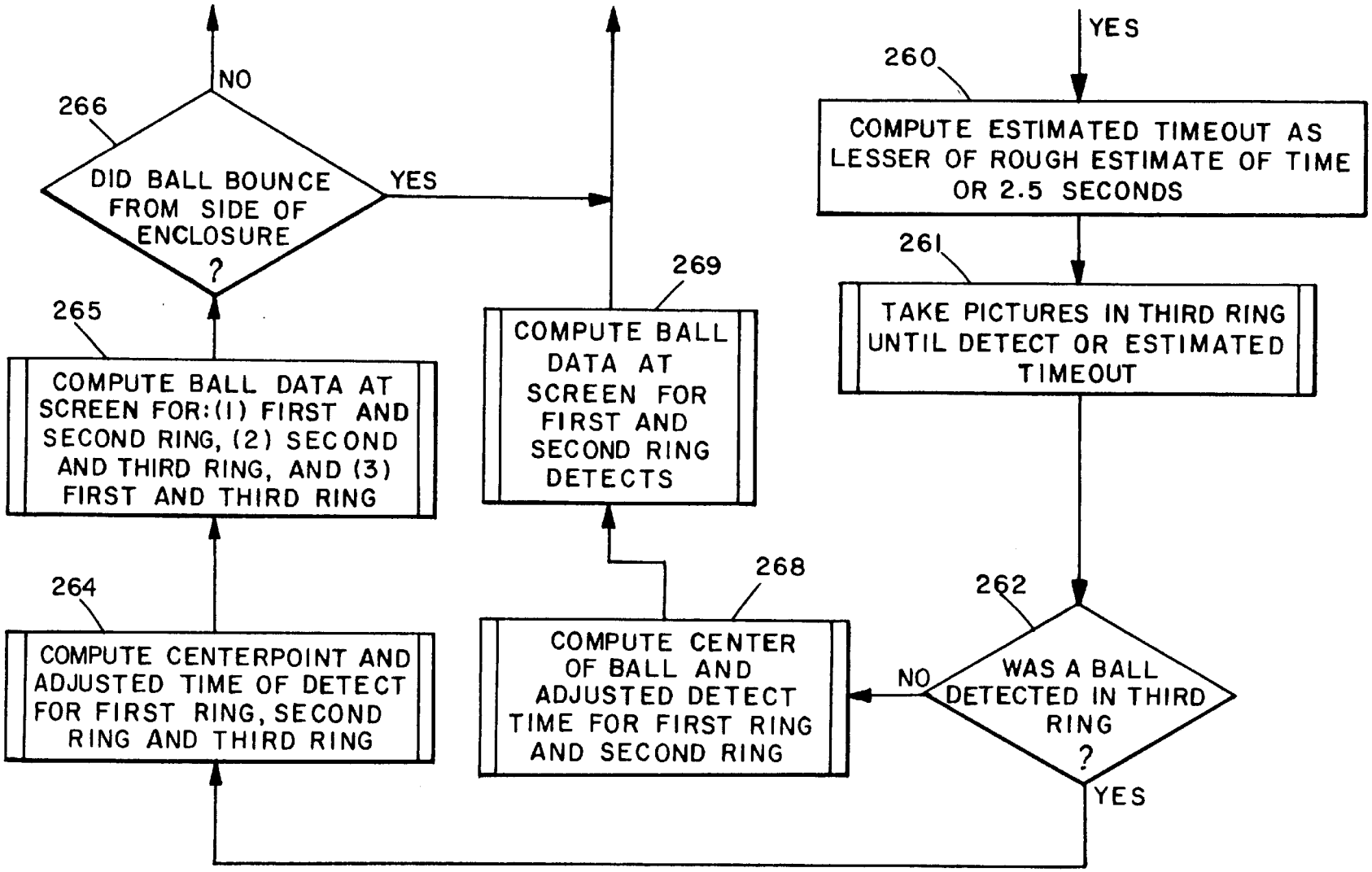
FIG. 8A/2

GOLF SIMULATOR

BACKGROUND OF THE INVENTION

The present invention relates generally to computer-based sports simulators which simulate the flight of objects such as balls in various types of sports in which a ball is struck by a player, and is particularly concerned with a golf simulator.

A large number of games utilize balls which are struck or thrown by a player, either directly using their hands or feet, or using a bat, racquet, golf club, or other device. Such games include basketball, soccer, baseball, tennis, hockey, and golf. Players of such games continually seek to improve their ball handling and aiming skills. There is therefore a large demand for practice areas for skill improvement in all types of ball sports.

The game of golf enjoys widespread popularity in a large number of countries of the world. A large amount of practice is necessary in order to reach any level of proficiency in this game, and continued practice is required at all levels of the sport. In order to improve their games, many golfers spend hours hitting golf balls at outdoor driving ranges. Such ranges cannot be used in bad weather conditions. The player has little feedback and will often become bored after repeatedly driving balls down the driving range. Additionally, the driven golf balls must be collected periodically. Another disadvantage of such outdoor practice ranges is that they take up a relatively large area.

In view of these disadvantages, computer-based golf simulators have been developed to allow the player to practice indoors, in a relatively small area, and also to see a constantly changing field of play on a screen so that they are less likely to become bored. Such simulators typically have an enclosure with a screen at one end, onto which an image of a fairway or part of a golf course is displayed. The player drives a ball towards the screen, and sensors are used to provide signals to a computer, which determines the trajectory the ball would have had if it had not been stopped by the screen. The computer then produces a video image of the ball traveling down the fairway.

One such simulator is described in U.S. Pat. No. 4,150,825 of Wilson. In this device, three overhead arrays of infrared sensors are located in the enclosure so as to establish three planes of detection between a tee area and the screen. Two of the detection planes are vertically oriented in the enclosure, while the third plane extends diagonally from the bottom of the screen to a location near the top of the vertical detection plane closest to the screen. Overhead infrared light sources direct infrared light through the space traveled by a ball towards the screen. The sensors detect the passage of the ball and provide corresponding outputs to a computer, and the computer uses the sensor inputs to determine the range and end position of the ball if it were not stopped by the screen. With this system, the actual position of the ball as it travels through each detection plane cannot be determined directly, but must be derived based on timing data generated when the ball breaks through the inclined detection plane closest to the screen. This technique increases computational errors, reducing the accuracy of the simulation. Another disadvantage of this system is that it is based on reflection of light from the ball to the sensors to provide the data necessary for generating the simulation. Due to the curved and dimpled surface of the ball, light reflected from the ball surface will tend to be dispersed, so that a larger number of sensors may detect the ball if each sensor has a broad field of view. Therefore, for this system to work, it is desirable to limit the field of view of each sensor, to avoid false detection errors. However, the optics associated with the sensors make it difficult and expensive to achieve the desired field of view restriction.

Another disadvantage of Wilson's system is that it does not compute or display the path of a putted ball or the path of a steep chip shot in which the ball breaks the plane of detection of the diagonal array and strikes the ceiling instead of the screen. Additionally, this system does not take into account the influence of obstacles such as trees on the travel of the ball.

U.S. Pat. No. 5,333,874 of Arnold et al. describes another golf simulation system in which two arrays of infrared emitters and detectors are provided in spaced vertical planes in the enclosure between the tee and the screen. When a ball interrupts the path between any emitter and an associated detector, the signal output from that detector is interrupted. The interrupted signal therefore provides data on the position of the ball. The array includes both vertical and horizontal sets of emitters and detectors, so that both the horizontal and vertical position of the ball at that detection plane can be determined. When the ball interrupts the path of an emitter and detector in the second plane, the time delay will provide an indication of ball speed, while the positions of the ball in the two planes will provide an indication of the direction of travel. This system also incorporates software which takes into account the influence of obstacles such as trees, slope, wind and the like on the travel path of the ball, and is therefore more realistic than Wilson's simulator. This system also avoids the problem of false detects which are inherent in a reflection-based detection system such as that described by Wilson. However, Arnold et al. cannot compute and display the path of balls putted less than four feet, and will also not compute and display the path of a very steep chip shot which strikes the ceiling between the two planes of detection. In other words, a ball must break both planes of detection in order for a path and final resting place to be computed and displayed on the screen.

SUMMARY OF THE INVENTION

It is an object of the present invention to provide a new and improved simulation system for ball games such as golf which predicts the final resting place of the ball more accurately.

According to one aspect of the present invention, an apparatus for simulating a ball game such as golf is provided, which comprises an enclosure having a launch or tee area adjacent one end for launching a projectile, a screen at the opposite end of the enclosure towards which a projectile is launched by a player, a projector for projecting an image of a playing area on the screen, a computer linked to the projector for producing a video image of the projectile as it would have traveled through the playing area, and a series of three, spaced vertical detection planes positioned between the tee area and the screen.

First, second and third emitters for transmitting electromagnetic radiation, preferably infrared (IR) radiation, are also positioned on the inner wall of the housing in the respective first, second and third planes, and three arrays of receivers, preferably IR receivers are positioned around the first, second and third detection planes, respectively. At least some of the receivers in the first plane are positioned to receive the electromagnetic radiation from the first emitter and to generate respective signals in response thereto. Preferably, a plurality of emitters are positioned on the housing in the first plane, such that each receiver in the first plane is in line-of-sight with at least one emitter. Likewise, at least some of the receivers in the second plane are positioned to receive the electromagnetic radiation from the second emitter and to generate respective signals in response thereto. The same follows for the emitters and receivers in the third plane. Preferably, a plurality of emitters are positioned on the housing in each plane, such that the receivers in the respective plane are in line-of-sight with at least one emitter in the same plane.

A computer is electrically connected to all three arrays of receivers for producing an estimate of the position, spin and velocity of the ball in response to the signals from the receivers, and for causing a video projector to project a video display of a predetermined golf course on the screen. To this end, the image of one or more predetermined golf courses is stored in the computer's electronic memory, and the computer causes a video projector to project an image of the portion of the golf course as would be seen from the tee area onto the screen. The computer also causes the video projector to project on the screen a video display of the golf ball as it would have traveled along a computed trajectory down the displayed golf course, if it would have flown into the scene depicted on the screen.

In one presently preferred embodiment, an electrical control circuit is provided, and the computer orders the control circuit to cause the emitters in the first plane to sequentially transmit pulses of infrared (IR) radiation. For each transmitted pulse, receivers that are in the same plane as the pulse transmitting emitter receive the IR transmission. Each selected receiver, through a signal conditioning, amplifying, and converting circuit, in turn sends a signal to the electrical control circuit, indicating either that the receiver has detected the IR transmission (i.e., that nothing has been interposed between the emitter and the receiver), or that the IR transmission has not been detected by the receiver (i.e., that a ball, e.g., a golf ball, has interrupted the line-of-sight between the emitter and the receiver). The control circuit sends the signals from the receivers to the computer.

The computer synthesizes the signals from the receivers and computes whether a ball (e.g., a golf ball) has passed through the first plane. If a ball has passed through the first plane, the computer determines where, in x-y coordinates, the golf ball passed through the plane, using standard triangulation techniques. The computer also identifies a time value designating when the ball passed through the plane. Also, in the event that a golf ball has passed through the first plane, the computer activates the emitters in the second plane. The operation of the emitters and receivers in the second plane is substantially identical to the operation of the emitters and receivers in the first plane. In the event that a golf ball has passed through the second plane, the computer activates the emitters in the third plane. The operation of the emitters and receivers in the third plane is substantially identical to the operation of the emitters and receivers in the first and second planes. If the receivers in the third plane do not detect a ball, the computer will determine where the golf ball has passed through the second plane, in x-y coordinates, as well as when the ball passed through that plane. Based upon the computed positions of the golf ball and the time values designated as it passed through the two planes, the computer determines the velocity (i.e., speed and direction) of the golf ball. If the ball is detected in the third plane, the computer will determine the velocity (i.e., speed and direction) of the golf ball using data from all three planes.

After the golf ball strikes the screen, it rebounds back through the third plane, and the receivers in the third plane sense the passage of the golf ball through the third plane. The computer determines where, in x-y coordinates, the golf ball passed through the third plane on the rebound. Based upon the difference between the positions of the golf ball as it passed through the third plane before and after the ball hit the screen, the computer determines the spin of the ball, and thus the amount of hook or slice and/or overspin or underspin the ball had. A golfing simulation program, such as the "Links" program sold by Access Software, Inc., of Salt Lake city, Utah is stored in the computer. The computer sends the computed position and velocity of the golf ball and computed spin of the ball to the "Links" program, and the "Links" program causes the video projector to project a video image of the golf ball on the screen as the golf ball would have appeared traveling down the golf course along the computed trajectory.

BRIEF DESCRIPTION OF THE DRAWINGS

The present invention will be better understood from the following detailed description of a preferred embodiment of the invention, taken in conjunction with the accompanying drawings, in which like reference numerals refer to like parts, and in which:

FIG. 8A is a block flow chart detailing the top level logic;

DESCRIPTION OF THE PREFERRED EMBODIMENT

Figure 1:
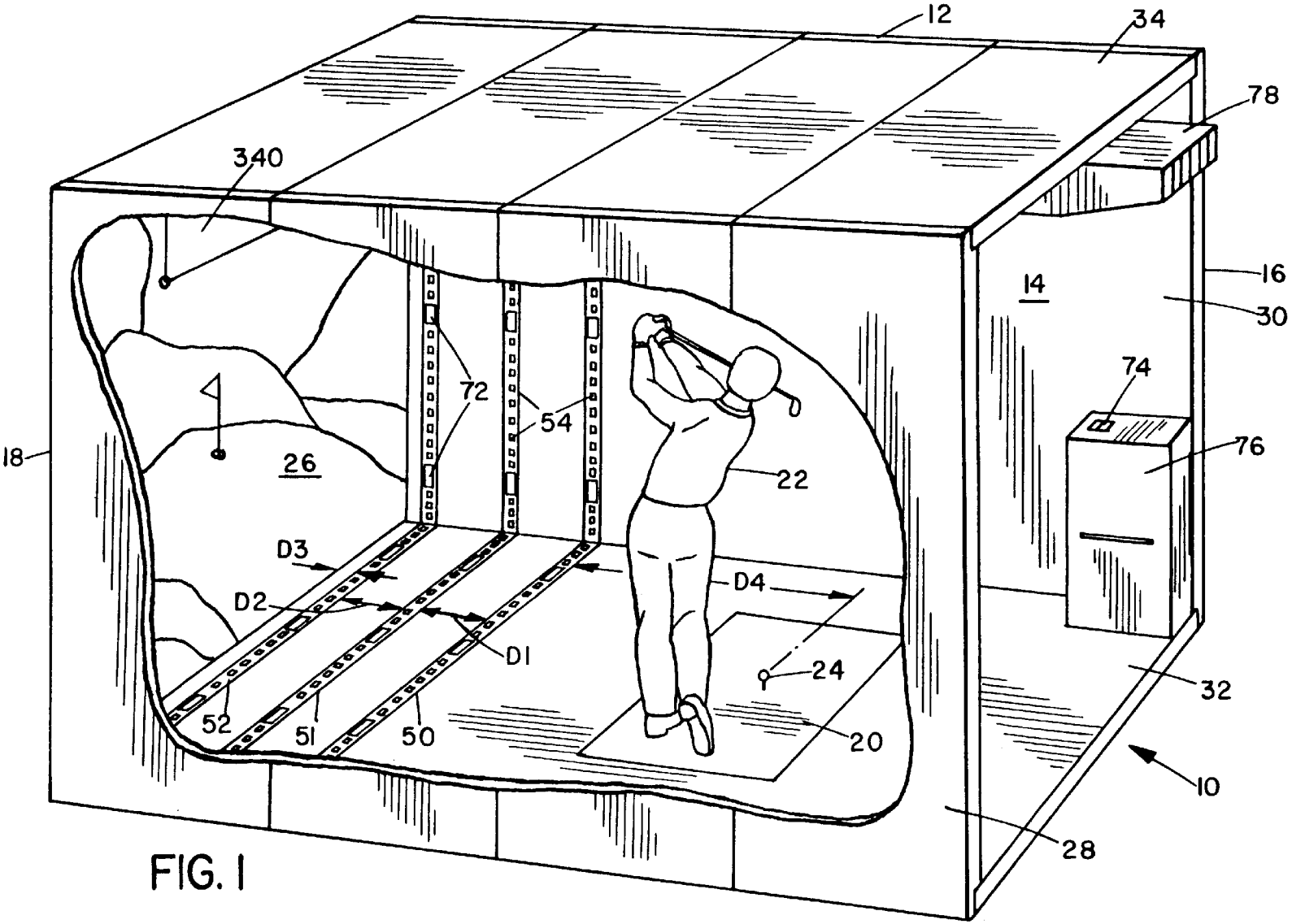
FIG. 1 is a perspective view of the sports simulator system according to a preferred embodiment of the present invention.

Referring initially to FIG. 1, a sports simulator system according to a preferred embodiment of the present invention is shown. The system is configured for simulating a golf game, and is generally designated 10. In the preferred embodiment shown, the system 10 includes an elongated parallelepiped-shaped housing 12 that defines an enclosure 14. The housing 12 has an open end 16 and a closed end 18. A tee area 20 is positioned near the open end 16, and a golfer 22 can drive, pitch, or putt a golf ball 24 into the enclosure 14 toward the closed end 18 of the housing 12.

To cover the closed end 18, a screen 26 is positioned on the housing 12 and is distanced from the tee area 20. The screen 26 is made of a shock absorbing material that is suitable both for stopping a golf ball, and for functioning as a substrate on which a video image can be projected. In one presently preferred embodiment, the screen 26 is white, and is made of a vinyl-type material marketed as Ultra-Flex™ by Leder-Burnell of Huntington Park, Calif.

Figure 13:
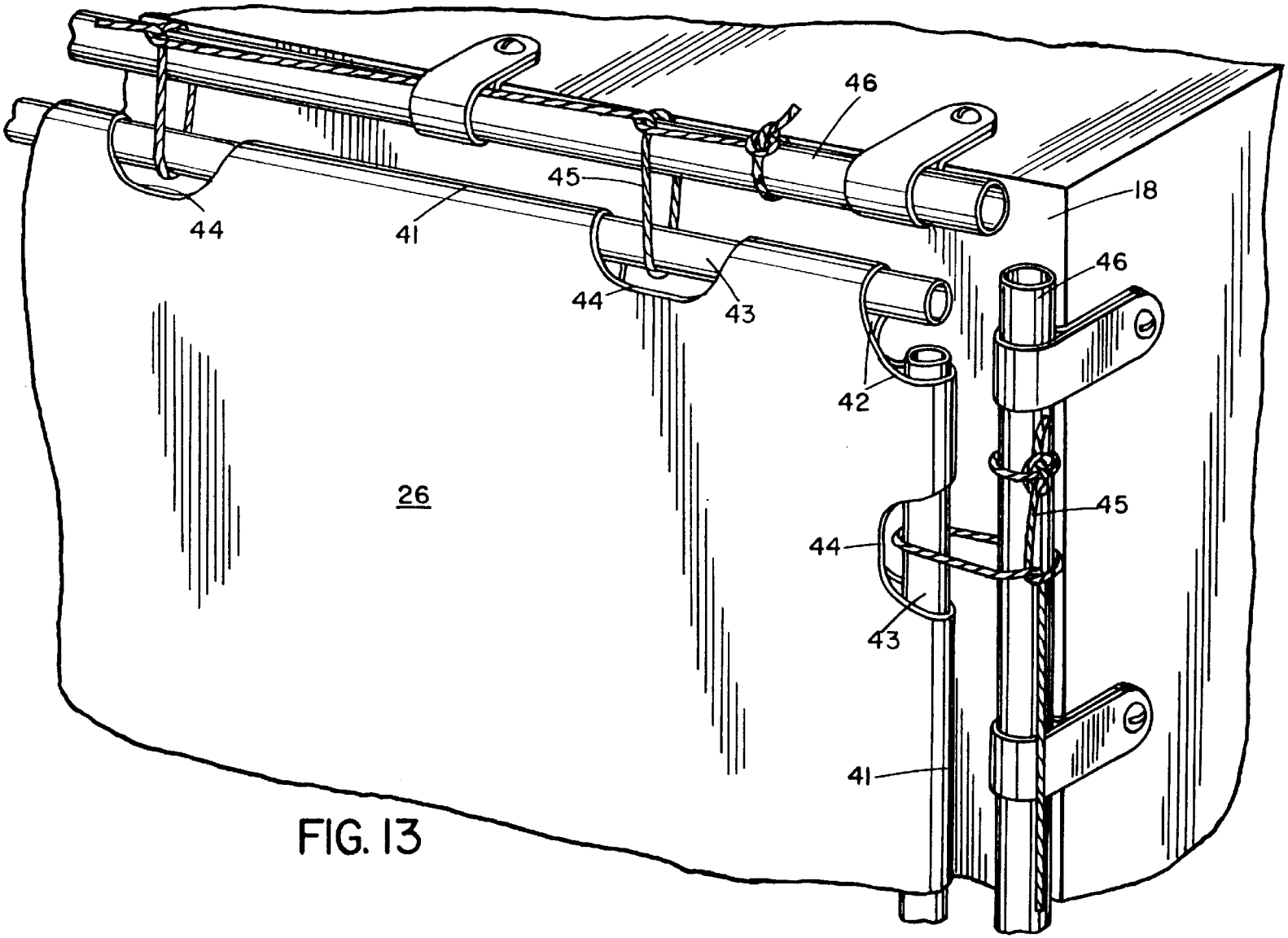
FIG. 13 is a plan view of the projection screen and support frame apparatus.
Figure 15B:
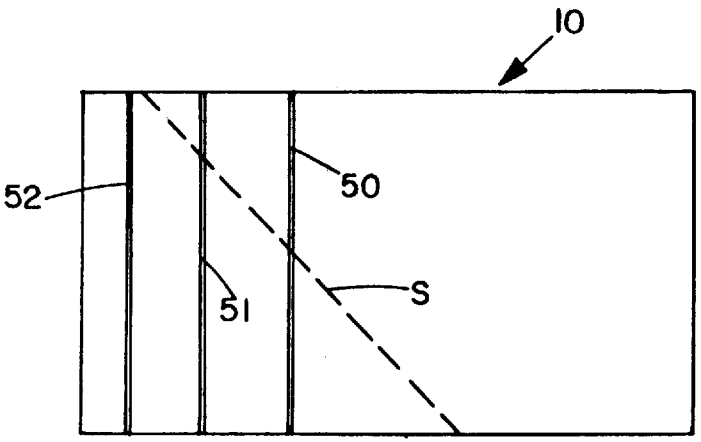
FIG. 15B is a view similar to FIG. 14B but illustrating a high chip shot.

Referring to FIG. 13, in the preferred embodiment, each edge 41 of the screen material forms an elongated sleeve 42 into which a stiff fiberglass rod 43 can be inserted. Portions of the sleeve 44 along each edge 41 are cut out so that an elastic cord 45 can be woven around the fiberglass rod 43. The cord 45 is used to lace the rod 43 and thus the edges 41 of the screen to a support frame 46 attached to the end 18 of the housing FIG. 13. This method of lacing the edge rods to the support frame permits a uniform tension to be applied to the entire surface of the screen. This assures that balls driven into the screen at the same velocity, spin and direction will bounce off the screen the same way each time permitting a more accurate estimate of ball spin as discussed later.

FIG. 1 also shows that the housing 12 has two side walls 28,30, a floor wall 32, and a ceiling wall 34. The walls 28,30,32,34 are preferably made of a lightweight, strong composite material, and can be easily and quickly joined together to facilitate rapidly erecting and disassembling the housing 12.

Preferably, the walls 28, 30, 32 and 34 of the housing 12 are constructed to minimize noise within the housing 12, and to absorb energy of impact with balls such as balls that are hit or deflected against them. In particular, in one preferred embodiment of the invention, the walls 28,30,32 and 34 include an inner surface 57 formed of carpet; an inner support 59 of 0.25 ACX plywood, although material such as 0.032 aluminum can alternatively be used; a central interior section 61 comprising material such as urethane in walls 28,30 and 34, and styrene cooler in the floor 32; and an outer support 63 of 0.032 aluminum, although 0.25 ACX plywood may alternatively be used.

Referring back to FIG. 1, three arrays 50,51 and 52 of electromagnetic radiation receivers 54 are mounted on the interior surfaces of the walls 28,30,32,34 of the housing 12. Preferably, each receiver 54 is substantially identical to the other receivers 54, and the receivers 54 can detect infrared (IR) radiation and generate an electrical signal in response thereto. In one presently preferred embodiment, each receiver 54 is a type BPW 34F IR receiver manufactured by Seimens.

As shown in FIG. 1, the arrays 50,51 and 52 define respective planes of detection. More particularly, each array defines a respective plane that intersects the housing 12, and the intersection between the plane and the housing 12 defines a polygon. The arrays 50,51 and 52 thus define the edges of respective polygons. In the preferred embodiment, the polygons are squares, and the planes defined by the arrays are substantially perpendicular to the longitudinal axis of the housing 12. In the embodiment shown, the distance D1 between the planes defined by the arrays 50 and 51 is about 23 inches. The distance D2 between the plane defined by the array 52 and 51 is about 25 inches and the distance D3 between array 52 and the screen 26 is about 8 inches. The distance D4 between the plane defined by the array 50 and the tee area 20 is about 66 inches, with the distances D1,D2,D3 and D4 being established in other embodiments as appropriate for the particular configuration of the system 10.

Figure 2:
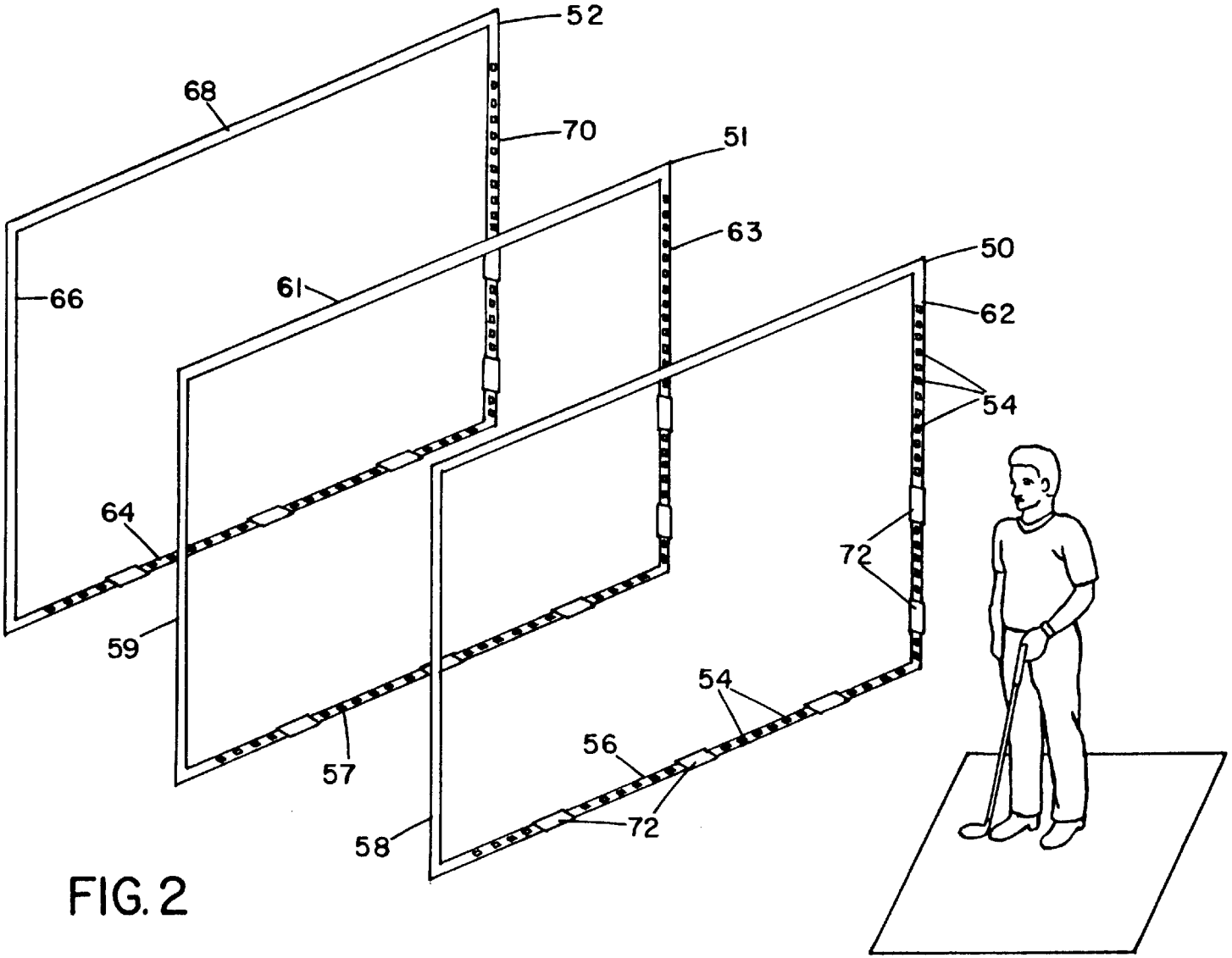
FIG. 2 is an exploded perspective view of the positional relationship of the three arrays absent the simulator housing.

For purposes of the present invention, the sides of the squares defined by the arrays 50,51 and 52 of IR receivers establish poles. With reference to FIG. 2, the first array 50 includes first through fourth poles 56,58,60,62, the second array 51 includes the fifth through eighth poles 57,59,62 and 63 and the third array 52 includes poles 64,66,68,70.

Additionally, each array 50,51 and 52 includes at least one electromagnetic radiation emitter 72, which is preferably an IR emitter, and each IR emitter 72 is in line-of-sight with at least one IR receiver 54 that is positioned in a different pole in the same array as the particular emitter 72. In one presently preferred embodiment, each IR emitter is a type L2168 emitter made by Hamamatsu.

Each pole of each array will include one or more IR emitters and an array of IR receivers. In the embodiment shown in FIG. 2, the distance between adjacent receivers 54 in the same pole is about 1.5 inches. Also, in the embodiment shown, 10 emitters are used in each array 50,51,52. These emitters are physically positioned about their array so as to give sufficient coverage over the entire array, and maximum detection in areas where balls are supposed to pass through. The distance from the end of a particular pole, i.e., 56,57, 60,61,64,68, and the receiver 54 in that pole that is immediately adjacent the end of the pole is about 0.25 inches. The location of the emitter 72 with respect to the particular pole 56,60,64,68 is based upon the strategic positioning of the emitter 72 as explained above. On the other hand, the distance from the end of a particular pole 58,59,62,63,66,70, and the receiver 54 in that pole that is immediately adjacent the end of the pole is about 0.75 inch. Once again the distance between the end of a particular pole 58,59,62,63, 66,70, and an adjacent emitter 72 in that pole that is based upon the strategic positioning of the emitter 72 as explained above.

Preferably, poles 56,57,60,61,64,68 (comprising the floor and ceiling poles), include ninety six (96) IR receivers 54 each, and three (3) IR emitters 72 each. Poles 58,59,62,63, 66,70 (comprising the side poles) include seventy six (76) IR receivers 54 each, and two (2) IR emitters 72 each. The skilled artisan will appreciate, however, that the precise number of receivers 54 and emitters 72 will vary, and the distance between adjacent emitters 72 and adjacent receivers 54 will vary, based upon the size of the housing 12 and the degree of desired accuracy of the system 10 in computing the trajectory of the golf ball 24.

FIG. 1 also shows that the system 10 of the present invention includes a computer 74 which is electrically connected to each of the emitters 72 and receivers 54. The computer 74 can be a personal computer, such as an IBM compatible PC. In accordance with the present invention, the computer 74 is electrically connected to an electrical control circuit (not shown in FIG. 1), which circuit is more fully described below. The control circuit can advantageously be housed in a computer console 76, along with the computer 74, for compact unitary stowage of the electrical control systems of the present invention.

The computer 74 is also electrically connected to a video projector 78 (electrical connection not shown), and the projector 78 is oriented to project a video image on the screen 26 in response to signals from the computer 74. As shown in FIG. 1, the projector 78 is preferably mounted on the ceiling 34 of the housing 12 by bolting the projector to brackets (not shown) and then bolting the brackets to the ceiling 34. In one presently preferred embodiment, the projector 78 is a Multisync Projection System by NEC, Model 6PG XTRA.

Figure 3:
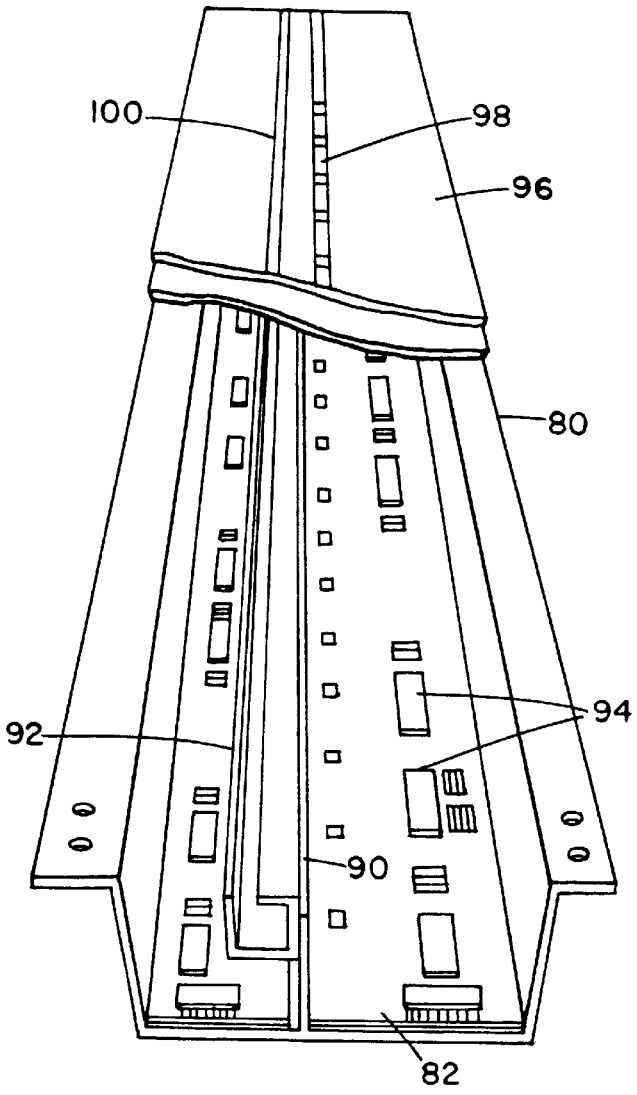
FIG. 3 is a perspective view of a portion of one array of infrared (IR) emitters and receivers, with portions cut away for clarity.

Now referring to FIG. 3, the construction of a portion of the pole 56 of the present invention can be seen. It is to be understood that the construction of the poles 58–70 is substantially identical to the construction of the pole 56, with the exception noted above that the floor and ceiling poles 56,57,60,61,64,68 have more receivers 54 and emitters 72 than the side poles 58,59,62,63,66,70.

As shown, the pole 56 includes a rigid, preferably metal base 80. The base 80 includes a receiver flange 82 formed with a plurality of holes 84 therein, so that a respective receiver 54 can be mounted on the base 80 in juxtaposition with a hole 84. Also, the base 80 has an emitter flange 86, and the emitter flange 86 is formed with a plurality of emitter openings 88. A respective emitter 72 can be mounted on the base 80 in juxtaposition with an emitter opening 88.

FIG. 3 further shows that the base 80 also includes a first blocking member 90 located so as to be interposed between the emitters 72 and the receivers 54 that are in the same pole to prevent saturating the receivers 54 with IR radiation from an immediately adjacent emitter 72. Also, the base 80 has a second blocking member 92 positioned so as to be on the side of the emitters 72 that is opposite the first blocking member 90. Additionally, integrated circuitry 94, which is the physical embodiment of much of the electrical control system discussed below, is mounted by well-known means on the base 80.

Still referring to FIG. 3, an opaque cover 96 can be mounted onto the base 80 by conventional means such as gluing the cover 96 to the base 80. As shown, the cover 96 has a first transparent, preferably polycarbonate window 98 for permitting infrared (IR) radiation external to the base 80 to impinge upon the receivers 54. Also, the cover 96 has a second transparent, preferably polycarbonate window 100 for permitting infrared (IR) radiation that is emitted from the emitters 72 to pass through the window 100.

The opaque cover 96 also acts as a baffle to direct light from the emitters 72 in the appropriate direction, and thereby prevent reflection of stray light from the emitters 72 at other places in the simulator 10. Such stray light can reflect off interior walls and affect the contrast of the ball shadows, thereby reducing system reliability. The opaque cover 96 also protects the electronics contained in the pole from damage due to impacts with balls such as balls hit into the simulator 10. The polycarbonate window 100 is preferably affixed to the inner surface of the cover 96 to cover the associated window hole in the cover 96. Recessing the window 100 in this manner protects it from contact with balls such as the ball, and thereby helps it to remain optically clear.

Figure 4:
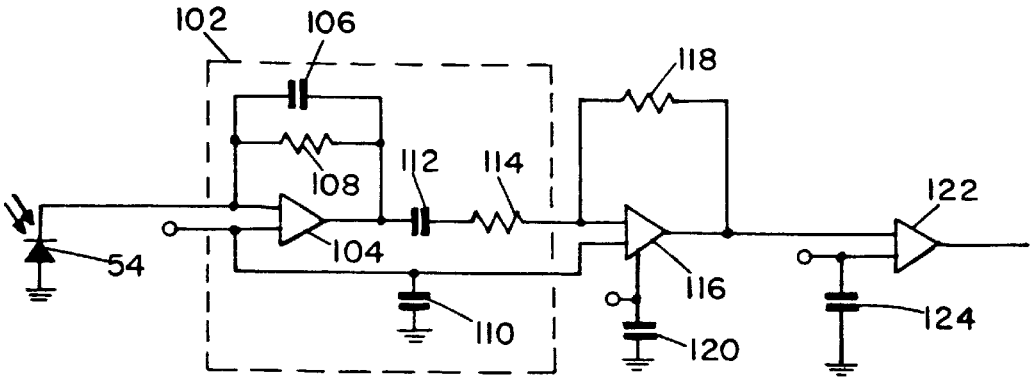
FIG. 4 is an electrical schematic diagram of the signal conditioning circuitry associated with one of the IR receivers.

Referring now to FIG. 4, the details of the electronic signal conditioning circuitry contained on receiver/emitter control board 130, for a single receiver can be seen. Preferably, each receiver/emitter control board 130 contains several of these circuits of FIG. 4, each connected to a separate receiver. For example, in one preferred embodiment, each control board 130 contains sixteen of the circuits of FIG. 4. The signal conditioning circuits of FIG. 4 are connected to a signal communication circuit which is also preferably contained on the board 130 for accumulating the signals from the several signal conditioning circuits and communicating them to the serial control board 128 for processing by the C30 board 126. Such a signal communication circuit is also preferably contained on each communication control board A0–B5 (FIG. 5), and thus, this circuit will be more fully described hereafter with reference to FIG. 7A. The skilled artisan will appreciate that FIG. 4 shows but one particular design of the signal conditioning circuit of the present invention, and that other circuits may be used without departing from the scope of the present invention.

As shown in FIG. 4, each receiver 54 is connected to a transimpedence amplifier 102 which converts the electrical current signal from the receiver 54 to a voltage signal. In one presently preferred embodiment, the transimpedence amplifier 102 includes an operational amplifier 104 of the type marketed as LF347N made by National Semiconductor, a 2 picofarad capacitor 106, and a 220K ohm resistor 108 are used to set the gain of the first stage operational amplifier 104.

As shown, the capacitor 106 and resistor 108 are connected in parallel with the operational amplifier 104. Also, the transimpedence amplifier 102 includes a 0.1 mfarad capacitor 110 which is connected to ground and a 6800 picofarad capacitor 112 in series with a 1K ohm resister 114, to form a high pass filter.

From the transimpedence amplifier 102, the voltage signal is conducted to a voltage amplifier 116. In one presently preferred embodiment, the voltage amplifier 116 is a second LF347N operational amplifier, and an 8.2K ohm resister 118 is connected in parallel with the voltage amplifier 116, thereby forming a feedback resistor for setting amplifier gain. Also, the voltage amplifier 116 is electrically connected to a 0.1 microfarad capacitor 120 and thence to ground.

From the voltage amplifier 116, the signal is conducted to a comparator 122 which essentially functions as an analog-to-digital converter. Preferably, the comparator 122 is an LM339 comparator, made by National Semiconductor. When the voltage signal from the voltage amplifier 116 has an amplitude greater than a predetermined set point, the comparator 122 outputs a digital "0", indicating that the receiver 54 detected a burst of IR radiation from an emitter 72 (and, hence, that no ball was interposed in the line-of-sight between the receiver 54 and the emitter 72). Otherwise the comparator outputs the digital "1" indicating that the receiver 54 did not detect a burst of IR radiation from an emitter 72 (and, hence, that a ball was interposed in the line-of-sight between the receiver 54 and the emitter 72).

As shown, the comparator 122 is also connected to ground through a 0.1 microfarad capacitor 124. The output of the comparator 122 is conducted to a parallel-in, serial-out shift register, the operation and construction of which is more fully described below.

The overall configuration of the signal processing circuitry of the present invention can be described by reference to FIG. 5. There, it is seen that the personal computer 74 is electrically connected to a control module, preferably a commercially available TMS320C30 board made by Wintriss Engineering of San Diego, Calif. (hereinafter referred to as the "C30 board 126"). The personal computer 74 can be any suitable computer, for example, an IBM compatible personal computer. The personal computer 74 is used as a user interface to give commands to the C30 board 126 and, specifically, to command the C30 board 126 to activate the electronic components of the present invention. In other words, the personal computer 74 activates the C30 board 126 and the C30 board 126 controls the operation of the electronic components of the present invention.

The C30 board 126 is electrically connected to a serial controller 128 which will be described in greater detail with reference to FIG. 6 below. The serial controller 128 is, in turn, electrically connected to eight communications boards designated respectively A0,B0,A1,B1,A2,B2,A3,B3,A4,B4, A5,B5. Each communications board A0,B0,A1,B1,A2,B2, A3,B3,A4,B4,A5,B5, controls the communication of electrical signals to and from the receivers 54 and emitters 72 of a respective one of the eight poles 56–70 of the present invention.

More particularly, the communications board B0 controls the communication of electrical signals to and from the receivers 54 and emitters 72 of the pole 56 in the first array 50, and the communications board B1 controls the communication of electrical signals to and from the receivers 54 and emitters 72 of the pole 60 in the first array 50. The communications board B2 controls the communication of electrical signals to and from the receivers 54 and emitters 72 of the pole 57 in the second array 51, and the communications board B3 controls the communication of electrical signals to and from the receivers 54 and emitters 72 of the pole 61 in the second array 51. Also, the communications board B4 controls the communication of electrical signals to and from the receivers 54 and emitters 72 of the pole 64 in the third array 521, and the communications board B5 controls the communication of electrical signals to and from the receivers 54 and emitters 72 of the pole 68 in the third array 51. Thus, the communications boards B0–B5 control communications to and from the 96 receivers 54 and three emitters 72 in each of the ceiling and floor poles in the arrays 50,51,52.

On the other hand, the communications board A0 controls the communication of electrical signals to and from the receivers 54 and emitters 72 of the pole 58 in the first array 50, and the communications board A1 controls the communication of electrical signals to and from the receivers 54 and emitters 72 of the pole 62 in the first array 50. The communications board A2 controls the communication of electrical signals to and from the receivers 54 and emitters 72 of the pole 59 in the second array 51, and the communications board A3 controls the communication of electrical signals to and from the receivers 54 and emitters 72 of the pole 63 in the second array 51. Also, the communications board A4 controls the communication of electrical signals to and from the receivers 54 and emitters 72 of the pole 66 in the third array 52, and the communications board A5 controls the communication of electrical signals to and from the receivers 54 and emitters 72 of the pole 70 in the second array 52. Thus, the communications boards A0–A5 control communications to and from the 76 receivers 54 and two emitters 72 in each of the side wall poles in the arrays 50,51,52.

Preferably, the communications boards B0,B1,B2,B3,B4, B5,A0,A1,A2,A3,A4,A5 are physically mounted on a base, such as the base 80, which makes up one of the arrays 50,51,52. The construction and operation of the communication boards A0–B5 will be disclosed further below in reference to FIG. 7.

Figure 5:
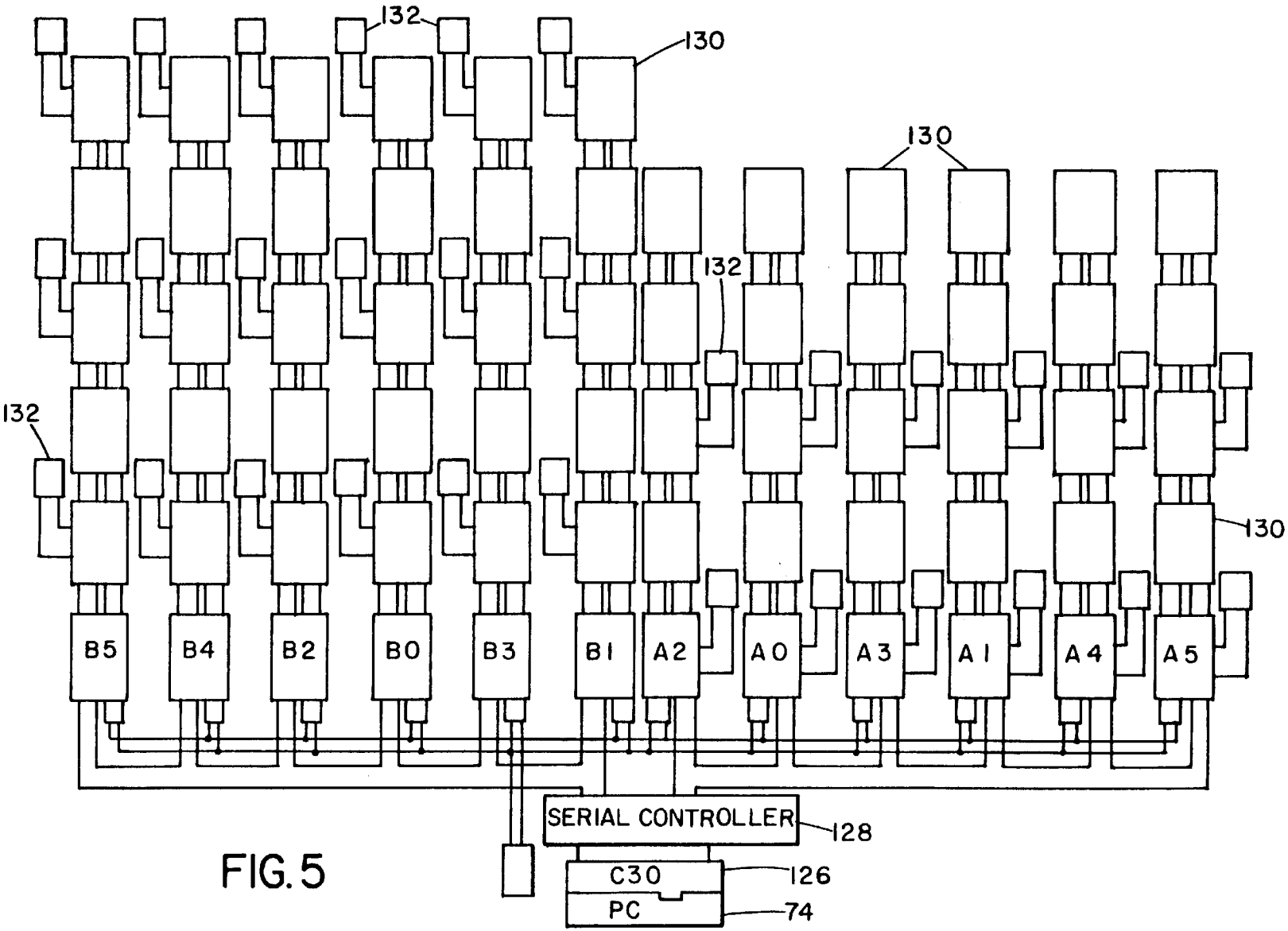
FIG. 5 is a block diagram showing the electrical control circuit of the present invention.

FIG. 5 further shows that each communication board is electrically connected to a series of receiver/emitter control boards 130. Each communication board A0–B5 directly controls 16 receivers 54 and each of the receiver/emitter control boards 130 located on its pole. For example, each of the communication boards B0–B5 is associated with a ceiling or floor pole 56,57,60,61,64,68, and each ceiling and floor pole has 96 receivers associated with it. Thus, each of the communications boards B0–B5 controls the communication of signals to and from 96 receivers 54.

On the other hand, each of the communication boards A0–A5 has only four receiver/emitter control boards 130 associated with it for controlling a total of 76 receivers. This is because, as stated above, the communication boards A0–A5 are associated with the side poles 58,59,62,63,66,70 of the three arrays of emitters which, as also stated above, have 76 receivers each.

Further, three of the receiver/emitter control boards 130 associated with each of the "B" communications boards is electrically connected to an emitter control circuit 132. In contrast, only two of the receiver/emitter control boards 130 associated with each of the "A" communications boards is electrically connected to an emitter control circuit 132. This corresponds to the above-stated number of emitters 72 in each pole 56–70. The receiver/emitter control boards 130 and the emitter control circuits 132 are mounted on a base of an appropriate one of the arrays 50,51,52, e.g., the base 80. Each communication control board A0–B5 is substantially identical to the other communication control boards. Also, each receiver/emitter control board 130 is substantially identical to the other receiver/emitter control boards, and each emitter control circuit 132 is substantially identical to the other emitter control circuits.

Thus, in response to commands from the C30 board 126, the serial controller 128 controls the transmission of infrared energy from the emitters 72 and the communication of electrical signals from the eight poles 56–70 of the present invention through the communication boards A0–B5 as more fully disclosed below.

Figure 6:
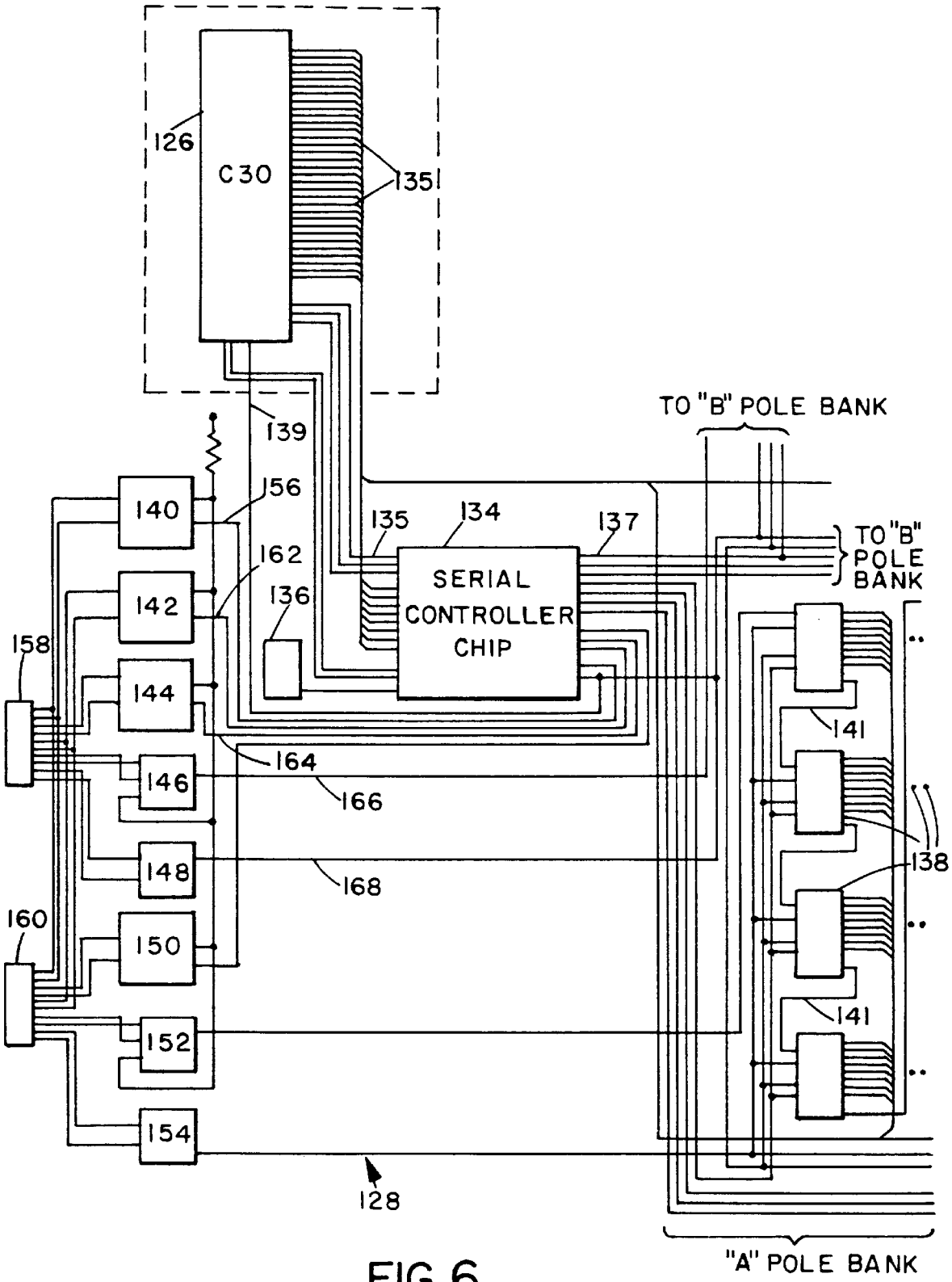
FIG. 6 is a block diagram showing the details of the serial control board of the present invention.

Now referring to FIG. 6, the details of the serial controller board 128 can be seen. As shown, the serial controller board 128 includes a serial controller chip 134. The serial controller chip 134 is a programmed logic chip, preferably of the type EP 5128 made by Alterra Corporation, and is electrically connected to the C30 board 126 via a plurality of command lines 135 by means well-known in the art.

FIG. 6 shows that the serial controller chip 134 is electrically connected to a twenty (20) megahertz clock 136. Also, the serial controller chip 134 is connected to two banks ("A" and "B") of serial-in parallel-out shift registers 138 via a plurality of read lines 137 by means well-known in the art (only "A" bank shown; successive shift registers 138 in each row of "A" bank designated by dots). Also, the C30 board 126 is electrically connected to one of the clock lines 137 (designated the "done" line for purposes of the present invention) via a data pick-up line 139.

While only the "A" bank is shown in FIG. 6, it is to be understood that the "B" bank is in all respects identical to the "A" bank, with the exception that each row in the "B" bank includes four serial-in parallel-out shift registers 138.

The "A" and "B" banks of shift registers 138 essentially accept data from a predetermined side pole 58,59,62,63,66, 70 or top/bottom pole 56,57,60,61,64,68, respectively. Stated differently, the "A" bank of shift registers 138 corresponds to the four side poles 58,59,62,63,66,70 and accepts data from their respective communications control boards A0–A5, and the "B" bank of shift registers 138 corresponds to the ceiling and floor poles 56,57,60,61,64,68, and accepts data from their respective communications control boards B0–B5. In other words, the "A" bank of shift registers 138 accepts data from a predetermined one of the poles pole 58,59,62,63,66,70 and the "B" bank of serial-in parallel-out shift registers 138 accepts data from a predetermined one of the poles 56,57,60,61,64,68.

Each serial in parallel out shift register 138 is preferably a chip designated 74HC595 made by Texas Instruments Corporation. As shown, the shift registers 138 are "daisy chained" together through lines 141 so that the shift registers 138 are serially connected. In this manner, data comprising signals from the receivers of each pole is serially shifted into and through the shift registers 138. This data identifies whether the particular receiver has detected the presence of a ball, such as a ball, passing between that receiver and the receiver that was fired. The serial organization of the data in the system creates a data string which can be evaluated as more fully described below to identify those receivers which have detected the presence of the ball.

FIG. 6 also shows that to effect communication between the serial controller chip 134 and the communication boards A0–BS, and to transmit signals from the communication boards A0 . B5 to their respective bank of serial-in parallel-out shift registers 138, a plurality of line drivers 140–154 are provided. The purpose of the line drivers 140–154 is to aid in the transmission of electrical signals between the serial controller board 128 and each one of the communication control boards A0–B3 that are located in their respective pole and are thus distanced from the serial control board.

In the particular embodiment shown, the line drivers 140,142,144,150 are type DS3695 line drivers made by Texas Instruments Corporation, and the line drivers 146, 148,152,154 are type 55ALS195 line drivers made by Texas Instruments Corporation. As shown, the input of the line driver 140 is electrically connected to the serial controller chip 134 via a line 156, and the output of the line driver 140 is connected to each of two connectors 158, 160 for transmitting a first clocking signal ("RCLK") from the chip 134 to the communication control boards A0–B5 via the connectors 158,160. The connector 158 is electrically connected to the "B" communication control boards (FIG. 5), and the connector 160 is electrically connected to the "A" communication control boards (FIG. 5).

As also shown, the input of the line driver 142 is electrically connected to the serial controller chip 134 via a line 162, and the output of the line driver 142 is connected to each of the two connectors 158,160 for transmitting a second clocking signal ("TCLK") from the chip 134 to the communication control boards A0–B5 via the connectors 158, 160.

FIG. 6 additionally shows that the line driver 144 is connected to the connector 158 and to a command line 164 that leads to the serial controller chip 134. The line driver 144 transmits an emitter control signal ("TDATA") from the chip 134 to the "B" communication control boards. Further, the line driver 146 is connected to the connector 158 and to an input line 166 that leads to the "B" bank of serial-in parallel-out shift registers 138 for receiving signals ("RDATA") from the "B" communication control boards.

The line driver 148, as shown in FIG. 6, is electrically connected to the connector 158 and to the "B" bank of shift registers 138 via a clock line 168 for transmitting a synchronizing signal ("RLOOPCLK") to the "B" communication control boards.

The line driver 150 is electrically connected to the connector 160 and the serial controller chip 134 and functions, for the "A" communication control boards, in a manner analogous to the line driver 144, as described above in relation to the "B" communication control boards. Also, the line drivers 152,154 are connected to the connector 160 and the "A" bank of serial-in parallel-out shift registers 138 for performing, for the "A" communication control boards, a function analogous to that described above for the line drivers 146,148 in conjunction with the "B" communication control boards.

Figure 7A:
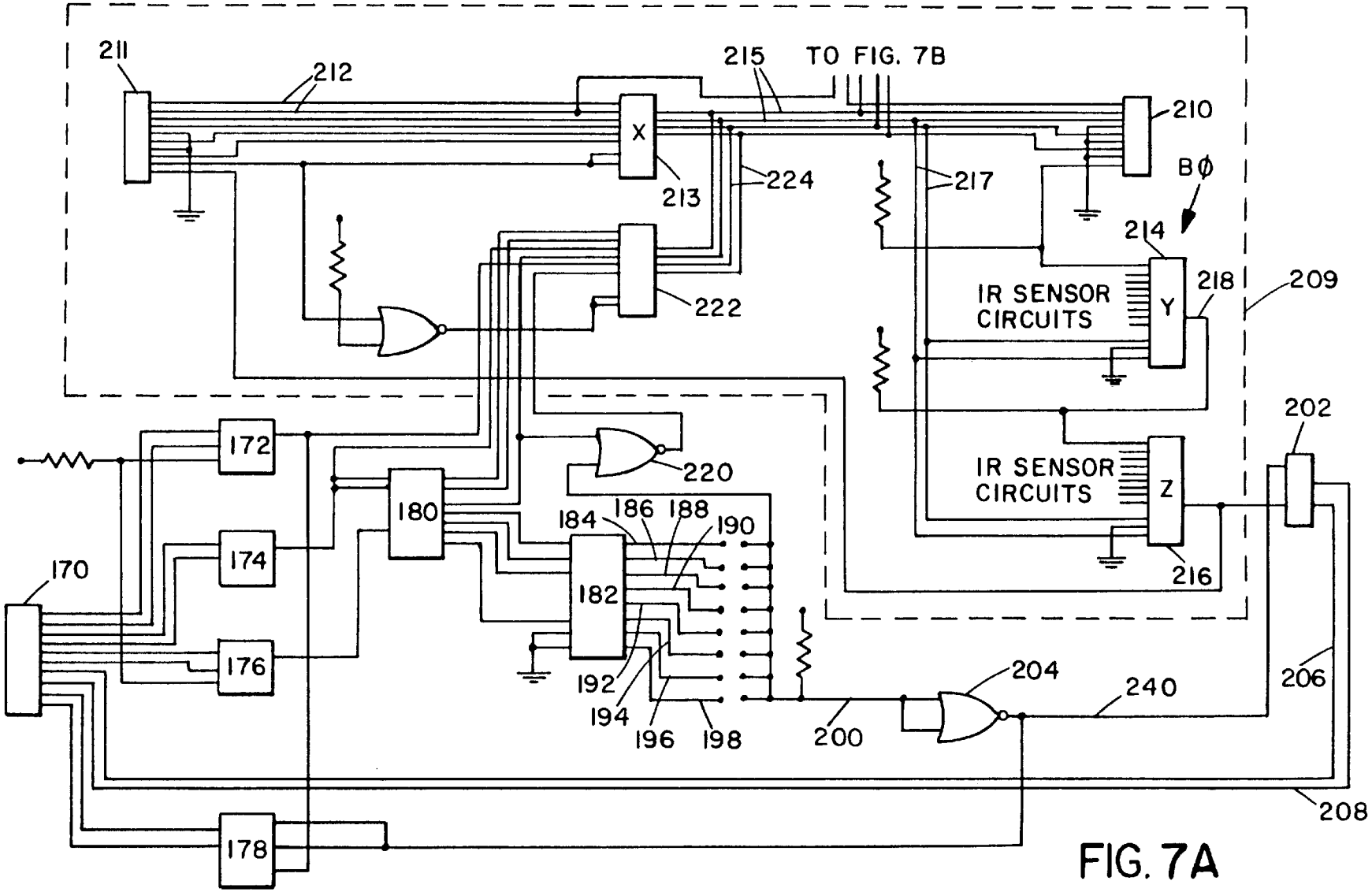
FIG. 7A is a block diagram showing the details of a first portion of a communication board of the present invention.
Figure 7B:
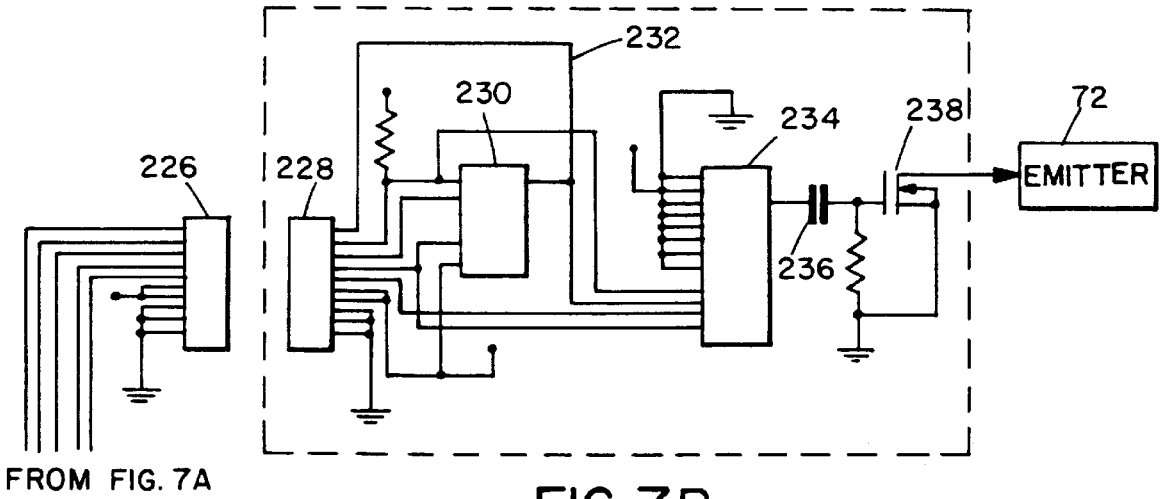
FIG. 7B is a block diagram showing the details of a second portion of a communication board shown in FIG. 7A.

Now referring to FIGS. 7A and 7B, the details of a single communications board, for example communications board B0, can be seen. It is to be appreciated that each communications board A0–A5 and B1–B5 is substantially identical to the communications board B0 in construction and operation. Further, each one of the communications boards A0–A5 and B1–B5 includes several of the signal conditioning circuits of FIG. 4 (as required to control those receivers directly connected to that communication board), as well as a signal communications circuit 209 (described below), which form the circuitry contained in the emitter/receiver control board 130. In addition to the circuitry which corresponds to that of the control boards 130, the communication board 130 includes circuitry necessary to transmit control signals from the serial control board 128 to the emitters 72 in the pole associated with the BO board, and to relay signals in serial order from the receivers 54 in the pole associated with the B0 board back to the serial control board 128.

FIG. 7A shows that the communication control board B0 has a connector 170 for receiving electrical conductors running from the serial control board 128. The connector 170 is electrically connected to three line receivers 172–176 and a line driver 178. Each line receiver 172–176 is preferably of the type 55ALS195 made by Texas Instruments Corporation, and the line driver 178 is a type DS3695.

The line receiver 172 is connected to the "RCLK" timing signal from the connector 170, while the line receiver 174 is connected to the "TDATA" signal from the connector 170. Also, the line receiver 176 receives the "TCLK" timing signal from the connector 170. On the other hand, the line driver 178 is provided and connected as shown to the "RLOOPCLK" signal to counterbalance the effects on the circuit of transmission delay by synchronizing the "RCLK" signal with return pulses from the receivers 54, as more fully described below.

As shown, the line receivers 174,176 are electrically connected to a serial-in, parallel-out shift register 180 preferably of the type 74HC164 made by Texas Instruments Corporation. In turn, the serial-in parallel-out shift register 180 is electrically connected to an address decoder chip 182 preferably of the type 74HC138 made by Texas Instruments Corporation. The output of the address decoder chip 182 is connected to eight leads 184–198, one of which (in the case of the B0 board, jumper lead 190) is jumpered as appropriate for the particular pole, the other leads being essentially open circuits. As shown in FIG. 8A, an output jumper lead 200 is electrically connected to a line driver 202 preferably through a 74HC02 chip 204 made by Texas Instruments Corporation. Also, two data leads 206,208 from the connector 170 are connected to the line driver 202 for transmitting the receive signals "RDATA") between the line driver 202 and the connector 170. Preferably, the line driver 202 is a type DS3695, manufactured by Texas Instruments Corporation.

FIG. 7A further shows that the communications board B0 also includes a signal communication circuit, generally designated 209, which corresponds to the signal communication circuits 209 on each of the emitter/receiver control boards 130. The signal communication circuit 209 includes a second connector 210 and, if required, a third connector 211. Recall that the receiver/emitter control boards 130 associated with the communication control board B0 are connected in series. This series connection between the boards is accomplished by interconnection of their individual connectors 210 and 211. For example, for any given board B0,30, the second connector 210 provides an interface to receiver/emitter control boards 130, if any, that are electrically upstream of the particular board associated with the connector 210. Also, the third connector 211 provides an interface to receiver/emitter control boards 130, or communications board B0, if any, that are electrically downstream of the particular board associated with the connector 211.

In the case of the B0 board, the second connector 210 receives input from the receiver-emitter control boards 130 that are associated with the communication control board B0. In particular, this connector 210 is electrically connected to the next board 130 up the line. As shown, a plurality of lines 215 extend from the second connector 210 to a buffer chip 213 of the type 74HC365, manufactured by Texas Instruments Corporation (designated "X" in FIG. 7A). A plurality of lines 213 extend from the third connector 211 to the buffer chip 213.

In turn, the buffer chip 213 is electrically connected, via lines 217, to a parallel-in serial-out shift register 214 (designated "Y" in FIG. 7A) of the type 74HC166 made by Texas Instruments Corporation. This shift register 214 is also serially connected to a second like shift register 216 (designated "Z" in FIG. 7A) via a line 218. Thus, the shift registers 214,216 are serially connected to each other and to the shift registers (not shown) of the associated receiver/emitter control boards 130 through the second connector 210.

Each one of the shift registers 214,216 receives input signals from eight of the signal conditioning circuits (FIG. 4) associated with the infrared receivers 54 of the present invention. As is known in the art, the parallel-in serial-out shift registers 214,216 can receive data in parallel from their associated signal conditioning circuits and output this data in serial format. The parallel-in serial-out shift registers 214, 216 thus receive data from associated receiver 54 circuits, and serially transfer this data back through the circuitry described above through the connector 170 to the serial control board 128 for processing by the C30 board 126.

Having disclosed the portion of the communication control board BO that is associated with the IR receivers 54, the details of the portion of the B0 board that is associated with an IR emitter 72 can be explained. As shown in FIG. 7A, the output jumper lead 200 is electrically connected to a NOR gate 220. Also, the NOR gate 220 accepts input from the shift register 180, as shown. When the NOR gate 220 receives both a signal from the shift register 180 ("LOADMODE") which indicates the proper time for an emission from any emitter 72, and a signal from the output jumper lead 200 that indicates the C30 board 126 has determined that an emitter 72 in the B0 pole will emit a burst of IR, the NOR gate 220 sends an emitter enable signal to a buffer chip 222. The buffer chip 222 functions as an amplifier and relays the signal from the NOR gate 220 as described below.

The buffer chip 222 can advantageously be of the type 74HC365 made by Texas Instruments Corporation. Further, the buffer chip 222 is electrically connected to the second buffer chip 213 via a plurality of lines 224.

FIG. 7B illustrates the emitter control circuit of control board 132, which interferes with the signal communication circuit 209 and which is also contained on the communication control board B0 when that board B0 is to be associated with an emitter 72 (FIG. 4). In this case, the output of the buffer chip 222 (and, hence, the output of the NOR gate 220) is electrically connected to an emitter port connector 226. The emitter port connector 226 is electrically connected to an emitter port receive connector 228, and signals from the emitter port receive connector 228 are sent to a shift register 230. Also, the shift register 230 receives a signal from the emitter circuitry (not shown) of the temporally precedent emitter 72 in the same pole as the shift register 230 (i.e., the emitter which emits IR in the cycle immediately preceding the cycle in which the shift register 230 is to initiate an emission). This signal is conducted from the circuitry of the temporally precedent emitter 72 to the shift register 230 through the connector 210 and through the emitter port connectors 226,228, and indicates whether the temporally precedent emitter 72 has indeed "fired". Also, the shift register 230 sends a signal to the emitter control circuitry (not shown) of the temporally subsequent emitter 72 to indicate whether the emitter 72 associated with the shift register 230 has fired. The shift register 230 can advantageously be a chip of the type 74HC164.

As further shown in FIG. 7B, one lead 232 from the emitter port receive connector 228, as well as the output of the shift register 230, are sent to an emitter control chip 234 of the type 74HC151. The output of the emitter control chip 234 is sent through a 0.1 microfarad capacitor 236 and a mosfet N transistor 238 and thence to one of the IR emitters 72.

The operation of the electronic circuity described above can thus be appreciated in reference to FIGS. 6, 7A, and 7B. To initiate one cycle of IR emitter firings in, for example, the first array 50 of emitters 72 and receivers 54, the C30 board 126 writes a series of bytes to the serial controller chip 134. This loads a corresponding series of registers in the serial controller chip 134. The first register is a fire pole select signal which determines which pole 56–70 will fire, i.e., the pole from which an emitter 72 will emit IR radiation, one bit of which also configures the serial-in parallel-out shift registers 214,216 to receive data from their receivers 54 ("LOAD MODE").

Also, the series of registers includes an emitter on time signal which determines how long the emitter 72 will emit IR radiation. The emitter on time signal essentially determines how many clock cycles, in 100 nanosecond increments, the selected emitter 72 will emit. In the presently preferred embodiment each emitter 72 emits IR radiation for 3.8 microseconds.

The series of registers also includes a read pole select which determines which of the poles 56–70 will be read. One presently preferred embodiment of the present invention envisions that two poles 56–70 will be read in any one cycle, with the two poles being selected to be generally opposite the pole in which the selected emitter is firing. In alternate embodiments, however, when an emitter 72 fires in one pole of an array 50,51,52, the data from the receivers 54 in the remaining three poles or alternatively, in all of the poles, of the array can be read.

Further, the series of registers includes an emitter count and board count. The board count essentially tells the serial controller chip 134 how many bits to read back from the communication control board B0. The emitter count identifies which of the emitters on the pole is to be fired. This number is currently set to equal ninety-six (96), to account for the maximum number of receivers 54 in any given pole. Finally, the series of registers includes a start signal.

Upon receipt of the start signal from the C30 board 126, the serial controller chip 134 toggles eight times, i.e., the serial controller chip sends out eight sequential bits on the "TCLK" line representing the fire pole select order. The bits are sent to the communications control boards A0–B5.

FIG. 7A shows that the TCLK signal is passed through the first connector 170 and line receiver 174 to the serial-in parallel-out shift register 180 and from thence to the address decoder chip 182. If the fire pole select signal indicated that the pole 56 associated with the B0 board shown in FIG. 8A is the pole that contains the emitter 72 to be fired, the fire pole select signal will be passed to the appropriate output port of the address decode chip 182 that corresponds to the line 190, i.e., the line that is jumpered. Otherwise, the fire pole select signal will not pass beyond the address decoder chip 182.

If the emitter 72 to be fired in the current cycle is in the B0 pole 56, the fire pole select signal is passed on to the AND gate 220. Also, the fire pole select signal is passed to the serial-in parallel-out shift registers 214,216 via a line 240 and the line driver 202 to configure the shift registers 214,216 to a load mode, wherein the shift registers 214,216 are configured to receive data from the receiver 54 130 circuits associated with the particular shift registers 214,216.

The NOR gate 220 outputs a zero signal (i.e., an "emitter enable" signal) only if two conditions are met. First, the fire pole select signal must be present at the NOR gate 220, thereby indicating that the B0 pole 56 contains the emitter 72 to be fired. Additionally, the "LOADMODE" signal must have been present in the "TDATA" fire mode select signal. Otherwise, the NOR gate 220 outputs a 1 which indicates that the emitter 72 to be fired is not in the B0 pole 56.

The emitter enable signal from the NOR gate 220 is conducted to the buffer chip 222 and from there to the emitter connectors 226,228 (FIG. 7B) and the shift register 230 which controls the emitter 72 operation.

The serial controller chip 134 next transmits a fire signal through the "RCLK" line to the line receiver 172. This fire signal includes a bit representing how long the emitter 72 is to emit IR. The "RCLK" fire signal is in turn conducted to the buffer chip and thence to the emitter connectors 226,228 shown in FIG. 7B.

It can now be explained that the shift register 230 causes the emitter 72 to fire if three conditions are met. First, the shift register 230 must receive a fire signal ("RCLK") from the serial controller chip 134. Also, the shift register 230 must receive an emitter enable signal from the NOR gate 220. Third, the shift register 230 must receive a bit from the adjacent receiver/emitter board 130 indicating that the temporally precedent emitter has fired, as described above.

After the emitter 72 fires, the shift register 230 will forward a "fired" bit to the control circuitry of the next emitter in the B0 pole 56 that is to fire. This "fired" bit indicates that the emitter 72 has fired so that the temporally subsequent emitter in the B0 pole will be set up to fire during the next fire order.

The operation described above applies to the B0 communication control board when the C30 board 126 has determined that the emitter 72 associated with the B0 board is to fire. In such an instance, the receivers 54 associated with the B0 board will not be set up to receive IR radiation. When the C30 board 126 has determined that the emitter 72 associated with the B0 board is not to fire, however, and that receivers 54 associated with the B0 board are to receive IR from an emitter in another pole (not shown in FIGS. 6, 7A, 7B), the IR receivers 54 must be set up to receive data.

To set up the IR receivers 54 in the B0 pole to receive data, the serial controller chip 134 pulses eight times to send an 8 bit "TDATA" signal through the line receiver 174 and thence to the serial-in parallel-out shift register 180. This "TDATA" signal is conducted through the address decoder chip 182 and jumper line 190 to the parallel-in serial-out shift registers 214,216, to cause the shift registers to latch data from their respective receiver 54 conditioning circuits.

Next, the serial controller chip 134 pulses 96 times to send an "RDATA" signal through the connector 170 and lines 206,208. The "RDATA" signal includes one or more bits that correspond to the two poles that were selected by the read pole select signal. Thus, the "RDATA" signal determines whether the parallel-in series-out shift registers associated with a particular communication control board A0–B5 will be read for data. Accordingly, when the B0 pole 56 is selected to be a "read" pole, the "RDATA" signal causes the parallel-in serial-out shift registers 214,216 to sequentially transmit data back through the connector 170 to the "B" pole bank of shift registers 138 in the serial controller board 128.

It is to be understood that the shift registers 214,216, and the shift registers for the entire series of receiver/emitter control boards in the B0 pole 56 which are serially connected to the shift registers 214,216 through the connectors 211,210, serially pass their total of 96 bits of data back through the circuitry described above. The skilled artisan will recognize that the use of parallel-in serial-out shift registers thus permits the use of only two receive signal leads between each communication control board A0–B5 and the serial controller board 128, instead of 96 leads that would otherwise be required if all 96 (or 76, in the case of A poles 58,59,62,63,66,70) receivers 54 in a pole reported their data simultaneously.

After the data from the communication control board B0 has been transferred to the serial controller board 128, the C30 board 126 reads the data in the B pole registers 138 of the serial controller board 128 and stores this data for use as further described below. In a like manner, the A pole registers 138 are filled with receive data from the particular communication control board A0–A5 that corresponds to the selected A pole.

Figure 8B:
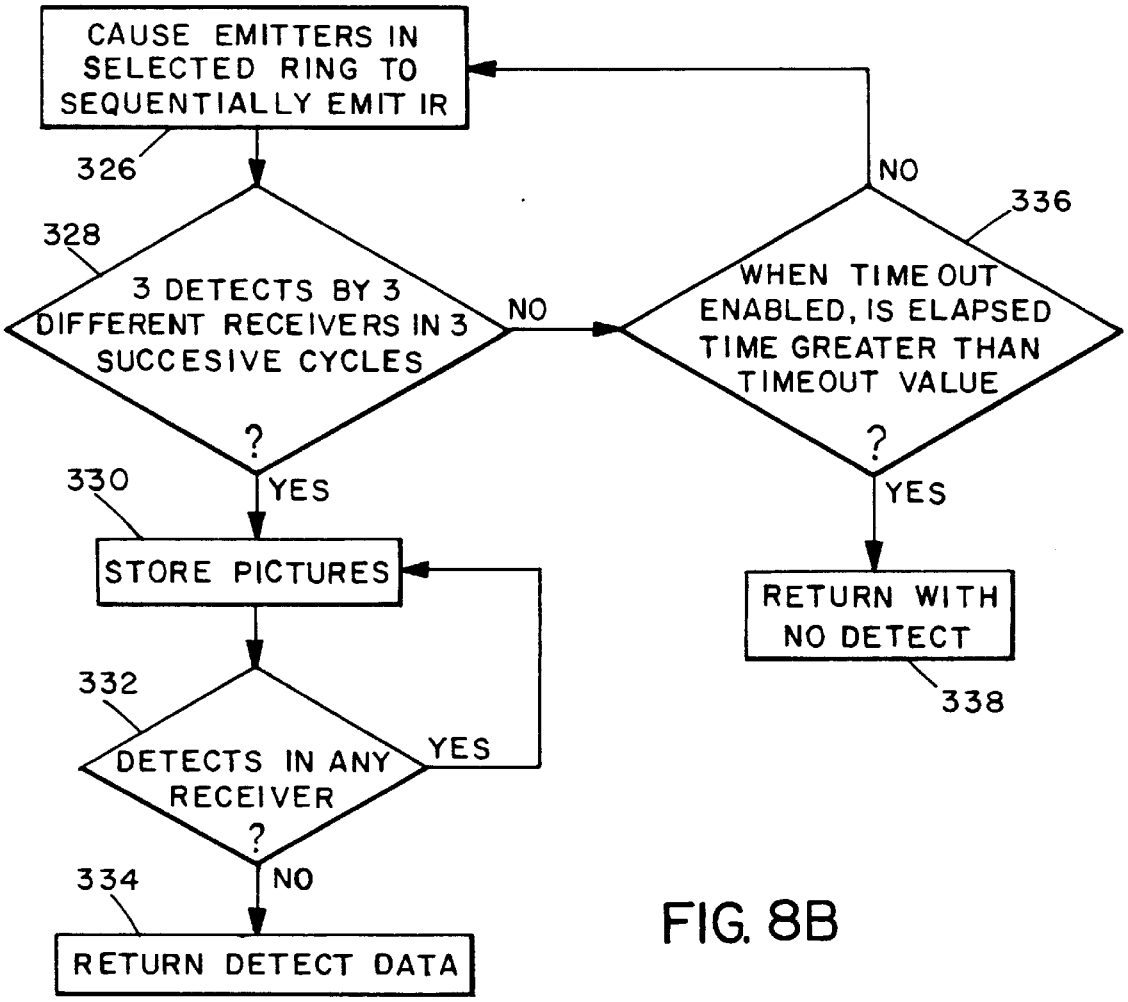
FIG. 8B is a block flow chart detailing sub-level logic.

FIG. 8A illustrates the overall logic of the C30 board 126 of the present invention in determining the position, velocity and spin of the golf ball 24 (FIG. 1). As shown at block 250 in FIG. 8A, the personal computer 74 initially orders the C30 board 126 to begin the process of taking pictures in anticipation of the golfer striking the ball. The computer also initializes an appropriate video display program, e.g. the "Links" program made by and commercially available from Access Software of Colorado, and causes a display of an athletic field, e.g., a golf course, to be projected onto the screen. The process of detecting the ball and taking the pictures proceeds as described in FIG. 8B and discussed below.

As shown in block 252, the process of taking pictures is initiated in the first array 50 with no time outs. As a ball is detected in the first array 50, pictures are taken of the ball and stored for later use. A time out is then computed for the second array 51. The timeout is computed as the lesser of the rough estimate of time or 2.5 seconds as shown in block 254. The rough estimate of time is based on the amount of time the ball required to pass through the first array 50. The rough estimate of time is the distance between the first array 50 and the second array 51 divided by the ball diameter times the amount of time the ball required to pass through the first array 50 which is doubled to allow for error which occurs in measuring the time the ball required to pass through the grid defined by the first array. For a slow ball, 300 or more pictures are possible. It takes approximately 133 microseconds to take a picture.

Upon detection of a ball in the first array 50, the C30 begins to take pictures in the second array as shown in FIG. 8B, with a time out value. The maximum time the second array 51 is allowed to look for a ball detect is limited by the time out computed in block 254. The process of taking pictures in the second array is shown in block 256. If a ball is not detected in the second array as shown in block 258, processing continues as shown in block 252 until a ball is again detected. This is necessary because of the possibility of false detects. If a ball is detected in the second array, another time out is computed as shown in block 260 and is identical to the computation of time out computed at block 254 except the distance between the first array 50 and the third array 52 is used to estimate the time of arrival of the ball at the third array.

Figure 9A:
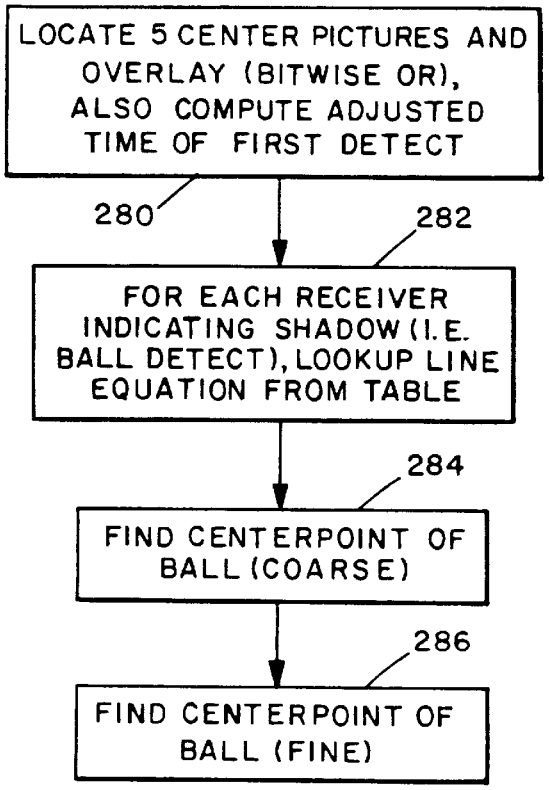
FIGS. 9A and 9B are block diagrams showing the logic followed by the computer of the present invention in determining the position, velocity and spin of a ball such as a golf ball.

Upon detection of a ball in the second array 51, the C30 board begins to take pictures in the third array 52 as indicated in block 261. The process of taking pictures is shown in FIG. 8B. The maximum time the third array is allowed to look for a ball detect is limited by the time out computed as shown in block 260. If a ball is not detected in the third array the data produced by the first and second array will be used to compute the ball data as shown at block 268 and the data will be returned to the PC for processing as shown in blocks 269,270 and 276. Processing in block 268 proceeds according to the FIG. 9A flowchart where center of ball and adjusted detect time is computed for the first and second array and forwarded to block 269 where processing proceeds according to the FIG. 9B flow chart where we use the two data points from block 268 to compute the ball data for forwarding to the PC by way of block 270. If the ball is detected in the third array 52, the ball data is computed as shown in blocks 264 and 265. The details of the computation in block 264 is shown in FIG. 9A. In this case, the computation of FIG. 9A is performed three times (one computation for each array's picture set) as opposed to twice as was performed at block 268 where there was no third array ball detect. In other words, the ball data is computed as in FIGS. 9A and 9B for the first and second array, the second and third array, and the first and third array.

Figure 9B:
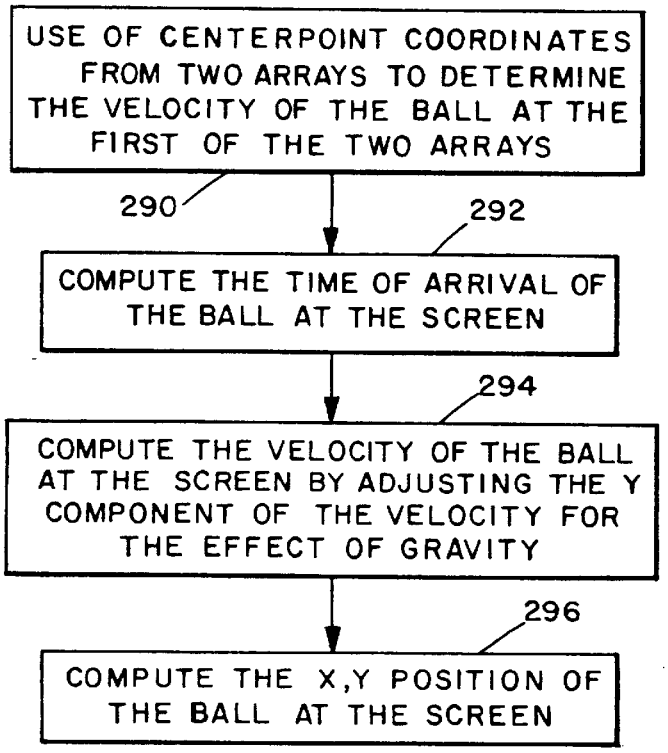

The computation of ball data at block 265 involves the sequence of steps shown in FIG. 9B. Again, three sets of ball data will be computed. Each computation will involve the center point and time of detect data from two of the arrays as computed in block 264. The order of computations and the data used is as follows: data from the first 50 and second arrays 51; data from the second 51 and third 52 arrays; and data from the first 50 and third 52 arrays. The ball data from each computation consists of five values: the x and y coordinates of the ball impact at the screen, and the x, y and z components of the velocity vector of the ball at impact at the screen. For purposes of the computation shown at block 265, x is the horizontal component going left to right, y is the vertical component going from bottom to top and z is the translational coordinate going from the tee into the screen. The ball data computed in block 265 will be used as described in block 271 unless it is determined that the ball struck the side of the enclosure between the second 51 and third 52 arrays as shown in block 266. In order to determine if the ball struck the side of the simulator, the x velocity component as computed in block 265 for the first and second array data is compared with the x velocity component computed in block 265 for the second and third array data. If the difference between the two exceeds a predetermined magnitude (in the preferred embodiment, the magnitude is 40 inches per second), the data from the third array 52 is not used and ball data produced by the first and second array 50,51 will be will be returned to the PC for processing as shown in blocks 270 and 276. If it is determined that the ball did not strike the side of the simulator, processing continues as shown in block 271. Each of the three sets of ball data computed in block 265 are averaged and a weighted average for each of the five values previously discussed is forwarded to the PC for processing as shown in block 272 and used by the Links software to compute and display the path of the ball on the screen. The relationship used for determining the weighted average is as hollows:

$$X_{avg} = \frac{(X_{12} + X_{23} + 2X_{13})}{4}$$

where $X_{avg}$ is the average horizontal component of velocity, $X_{12}$ is the computed velocity between the first and second planes, $X_{23}$ is the computed velocity between the second and third planes, and $X_{13}$ is the computed velocity between the first and third planes.

After the data is forwarded to the PC from block 271, the C30 board continues to take pictures in the third array as shown in block 273 for the purpose of detecting a ball rebounding off the screen. If no rebound is detected, the zero detect data is sent to the PC for processing as shown in block 276. If a rebound is detected within the one second timeout, the spin of the ball is computed as shown in block 278 and then forwarded to the PC for processing. Balls which are detected in the second array but not the third array are indicative of short putts or chip shots. Balls which are detected in the third array that do not rebound are indicative of longer putt shots. With reference to FIG. 1, a weighted screen or curtain 340 is suspended from the top wall of the simulator between the second and third arrays 51,52 close to the third array 52. The screen traps chip shots which strike the ceiling between the second and third arrays from bouncing off the top of the simulator and crossing the detection plane of the third array 52.

With reference to FIG. 8B, the method for "taking pictures" proceeds as follows. As previously, indicated, the C30 board 126 causes the emitters 72 in the respective array to sequentially emit infrared radiation with about 133 microseconds between emissions as shown in block 326. Thus, the first emitter 72 in the array will emit a burst of infrared radiation. One hundred thirty-three microseconds later, the second emitter 72 in the array will emit a burst of infrared radiation, and so on.

As indicated at decision block 328, upon detection of a shadow from any one receiver 54, the C30 board 26 temporarily stores that detection and determines whether three different receivers 54 have detected a shadow in three successive cycles of IR radiations after the first detection. This is to ensure against the processing of false detections. If a detection was false as determined in decision block 328, the C30 board 126 proceeds to block 336. In block 336 the C30 determines if the timeout is non-active (non-active if the timeout value is 0). Then, the C30 compares the current time with the timeout computed (processed in blocks 256, 261 and 273 of FIG. 8A) and if the current time is greater than the timeout the processing proceeds as per the relevant block in the FIG. 8A flowchart with no ball detect data being forwarded as indicated in block 338. Otherwise, the C30 board 126 proceeds to block 330 wherein the pictures indicating the detections are stored.

If the receivers 54 of the array are no longer detecting the ball 24, as indicated at decision block 332, the C30 board 126 proceeds to block 334 indicating the ball is detected and where the picture data is being forwarded for processing at the relevant block in the FIG. 8A flow chart.

With respect to the computations referenced at blocks 264–278, it will be appreciated that in order to accurately predict the flight of a golf ball, both ballistic and aerodynamic phenomena must be taken into account. After the golf ball leaves the golf club, ballistic and aerodynamic forces are the only influences on the ball during flight. The amount of "lift" or "dive" of the golf ball can be predicted by measuring the rotational speed component or "spin" of the golf ball around an axis parallel to the floor and perpendicular to the walls. The amount of "hook" or "slice" of the golf ball can be predicted by measuring the spin of the golf ball around an axis parallel to the screen and perpendicular to the floor.

The term velocity where used is used in the engineering sense. Velocity is a vector quantity with components of both speed and direction. The golf ball departs the golf club with two types of velocity, rotational and translational. Translational velocity is composed of speed and direction (3-dimensional). Rotational velocity is composed of ball rotational speed and rotational axis orientation (3-dimensional).

Translational velocity can be obtained by noting the position and time of passage of the golf ball through the three infra-red detection arrays 50,51 and 52. Rotational velocity or "spin" can be obtained by noting the position and time of passage of the golf ball through the infra-red detection array 52 closest to the screen as the ball moves toward the screen and again as it bounces off the screen and passes back through array 52, moving away from the screen.

Stated differently, after a driven or pitched golf ball 24 passes through the plane defined by the third array 52, the ball 24 will hit the screen 26 and then bounce back through the plane defined by the third array 52 on a rebound. The angle of the rebound is indicative of the spin of the ball 24, and the spin of the ball 24 affects the computed trajectory of the ball 24. Thus, for driven or pitched golf balls, the spin of the ball must be determined. For putted (i.e., rolling) balls, however, the spin of the ball need not necessarily be calculated.

As noted above, in block 273 the C30 board 126 takes IR pictures of the ball 24 in a manner as described above in FIG. 8B during the rebound of the ball through the plane defined by the third array 52. A timeout value of one second is used. Then, the C30 board 126 moves to block 278, wherein the C30 board 126 calculates the velocity, spin and position of the ball at the plane defined by the first array 50 through the standard geometric techniques further disclosed below. For putted golf balls, the C30 determines only the velocity and position of the balls.

After calculating the average velocity, spin and position of the ball 24 using data from all three arrays as described above, the C30 board 126 calculates what the velocity, spin and position of the ball 24 was when it struck the screen 26 (block 278) and sends this projected position, velocity and spin to the video program, which in one preferred embodiment is the "Links" program (block 250).

When the video program receives the data from the C30 board 126, the video program then causes the projector 78 to project a video display of the ball 24 on the screen 26 as the ball 24 would have traveled down the projected fairway but for screen 26 blocking the ball 24.

With reference to FIG. 9A, the C30 board 126 at blocks 252,256 and 261 (FIG. 8A), first determines, a set of pictures from each of the arrays 50,51,52. In blocks 264 and 268, the processing in FIG. 9A is used to compute the x,y coordinate of the golf ball as it passed through each individual array. In block 280, the five center pictures for each golf ball 24 passage event through the plane defined by the respective array are identified. By five center pictures, the present invention intends that in a series of pictures detecting the passage of the ball through the plane defined by the respective array as shown the five temporally middle pictures are selected.

These five center pictures are overlaid on each other using a bit-wise "or" command as indicated in block 280. As indicated at block 282, for each receiver 54 that indicates the detection of a shadow, i.e., the detection of the ball 24, the C30 board 126 looks up the appropriate line equation from a pre-stored table. More specifically, the line equation describes an imaginary line which extends between each emitter 72 and each receiver 54 in the same array as the emitter 72. The C30 board 126 records the time that each emitter 72 fires and the time that each receiver 54 reports whether it did or did not receive an infrared transmission. Thus, if a particular receiver 54 reports that it did not receive an infrared transmission from an emitter 72 when one was expected, the C30 board 126 knows which emitter-to-receiver line was being blocked by the ball 24 and retrieves the equation of this line from the predetermined table, and stores the equation of this line in memory.

From block 282, the C30 board 126 proceeds to block 284 wherein the C30 board 126 determines the center point position, in x-y coordinates, of the ball 24 as it passed through one of the planes defined by the arrays 50,51, and 52. The determination at block 284 is a coarse determination. This coarse determination is explained further below in reference to FIG. 10.

From block 284, the C30 board 126 proceeds to block 286, wherein the C30 board 126 refines the center point x-y position of the ball 24 as it passed through the plane defined by the array. This fine determination is explained further below in reference to FIG. 11. Thus we have computed an x,y coordinates for a ball passing through a single array. From block 286, the C30 board 126 proceeds with processing as per the relevant block in the FIG. 8A flowchart.

With reference to FIG. 9B, the C30 board 126 uses the X-Y value as computed in 9A for any two arrays and will compute the velocity and position of the ball at the point where it would pass through the plane of the screen. More specifically, at block 290, the C30 board 126 uses the position of the ball in X-Y coordinates as the ball passed through the plane defined by the first array of the two arrays used. The C30 board 126 also uses the X-Y position of the ball 24 as it passed through the plane defined by the second array. Given the X-Y set of coordinates at two arrays and the time between ball detects the velocity of the ball at the plane defined by the first array can be determined as shown in block 290 by using the following relationships:

$$V_x = \frac{(X_2 - X_1)}{T}$$

where T is the elapsed time between passage of the ball through the two arrays $X_1$ is the x-coordinate of the center point of the ball as it passed the first of the two arrays being used, $X_2$ is the center point of the ball as it passed the second of the two arrays being used, and $V_x$ is the x-component of the velocity of the ball. This relationship is used to compute velocity $V_{12}$ from the first and second array date, velocity $V_{23}$ from data received from the second and third arrays, and velocity $V_{13}$ from data received from the first and third arrays.

For purposes of the present invention, the X direction is the horizontal direction when looking directly at the screen 26 shown in FIG. 1, i.e., the direction from left to right across the screen 26. The Y direction is the up and down direction when looking at the screen 26 in FIG. 1. The Z direction is the dimension which extends between the tee area and the screen.

The following equation is used to determine the y component of the velocity of the ball 24 at the plane defined by the first of the two arrays:

$$V_{y1} = \frac{((Y_2 - Y_1) - 1/2AT^2)}{T}$$

where A is the acceleration of gravity (384 inches per second, per second), T is the elapsed time between ball passage past the first and second arrays, and $Y_1$, and $Y_2$ are the y coordinates of the center point of the ball 24 as it passed through the planes defined by the first and second arrays.

Also, to determine the Z-component of velocity:

$$V_z = \frac{Z_0}{T}$$

where $Z_0$ is the distance between the two arrays. When the elapsed time of transit between the two arrays is large, it is most likely that the ball has been putted. In this situation, the Z component velocity calculation must take into account the deceleration of the ball due to the drag of the carpet or floor. In this case the equation for the Z-component of velocity is:

$$V_{z1} = \frac{Z_0 - 1/2DT^2}{T}$$

where D is the deceleration constant of the carpet.

Thus, in block 290, the C30 board 126 determines the velocity and position of the ball 24 as it passed through the first array. Using the equations of motion, the C30 board 126 can then project, at block 296, the position and velocity that the ball 24 will have had when the ball 24 strikes the screen 24.

The x, y and z components of velocity will be determined for passage of the ball through each array in the above manner, using the time delay between each pair of arrays (first and second, second and third, first and third) to produce three sets of data which are averaged as described above.

Because of the small distance between the arrays and the screen 26, environmental effects such as wind resistance are not taken into consideration in projecting the ball position onto the screen. However, the influence of gravity is considered as it affects the velocity in the Y axis. Accordingly, the values determined above for $V_x$ and $V_z$ are used as their respective velocity values at the screen 26. The velocity of the ball at the screen, in the Y axis is determined by the following relationships:

$$V_{yS}=V_{y1}+(A\cdot T_s)$$

where A is the acceleration of gravity (384 inches per second), and $T_s$ is the elapsed time between ball passage past the first of the two arrays used to ball impact at the screen 26, which time value can be found from the following relationship:

$$T_S = \frac{V_S}{V_Z}$$

where $Z_S$ is the distance between the first of the two arrays and the screen 26. Similarly, for a putt, the Z component of velocity is computed as:

$$V_{zS}=V_{z1}-D\cdot T_S$$

The position of the ball may be projected to the screen surface by the following relationships:

$$P_{xS}P_{x1}+(V_x\cdot T_S)$$

where $P_{xS}$ is position of along with the X axis, and $P_{x1}$ is position of the ball as it passed through the first array along the X axis.

$$P_{yS}=P_{y1}+(V_y\cdot T_S)+\tfrac{1}{2}AT_s^2$$

where $P_{yS}$ is position of the ball on the screen 26 along the Y axis, and $P_{y1}$ is position of the ball as it passed through the first array along the Y axis.

To determine the spin of the ball as shown at block 278, FIG. 8A, the computer compares the recorded positions of the center points of the ball as it passed through the third plane (i.e., the plane defined by the third array 52) going down the fairway and then as the ball returns through the third plane after the ball rebounds from the screen 26. From the position data and the times associated with the data, the ball velocity in each of three axes is determined both before screen impact and after screen impact.

Calculating the initial rotational velocity of the golf ball from the inbound and outbound velocity information assumes that the rotational energy of the ball is converted to translational energy during impact with the screen.

Note that it is important that the screen does not impart a bias value to this data, and therefore the screen mounting indicated in FIG. 13 was devised. Since only the backspin (which changes only the y-axis velocity) and the hook-slice spin (which changes only the x-axis velocity) are of interest, changes in the z-axis velocity may be ignored. This is important since the screen is designed to absorb energy in the z-axis (so that the golfer does not have to dodge the ball as it rebounds off the screen).

The screen is flat, and in a plane which is vertical and approximately perpendicular to the flight of the ball. Since the ball is usually traveling at an angle with respect to the plane of the screen, there is always an initial translational velocity, as well as a final translational velocity; this fact must be fully accounted for to make a reasonable estimate of the initial spin of the ball. The following formulas are implemented in the C30 board to calculate the spin of the ball:

$$\text{hook-slice} = 2.5 * \frac{(V_{xS} - V_{xR})}{R_b} = \frac{V_{xR}}{R_b}$$

$$\text{backspin} = 2.5 \cdot \frac{(V_{yS} - (V_{yR} - A \cdot T_R))}{R_b} + \frac{(V_{yR} - A \cdot T_R)}{R_b}$$

where $V_{xS}$ and $V_{yS}$ are the x-axis and y-axis velocities of the ball at the screen, $V_{xR}$ and $V_{yR}$ are the x-axis and y-axis velocities of the ball as it rebounds back through the frame nearest the screen, $R_b$ is the radius of the golf ball (1.69 inches), $T_R$ is the measured time of rebound, and A is the acceleration of gravity (384 inches per second).

The golf simulation software on the PC uses these initial spin values for backspin and hook-slice along with the total ball velocity to compute the flight of the golf ball which is projected on the screen.

Figure 10:
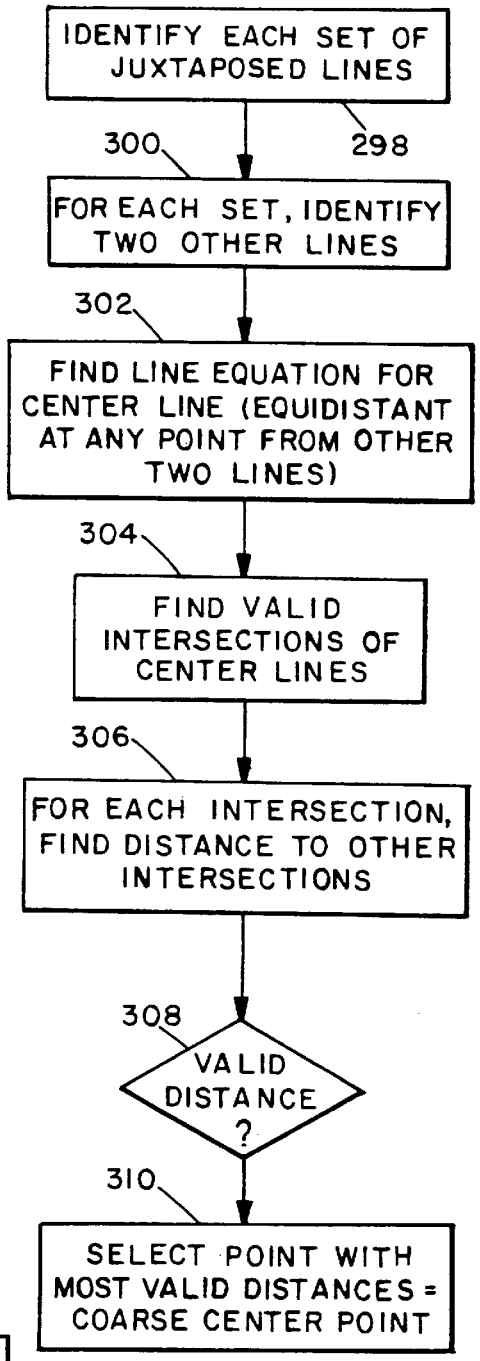
FIG. 10 is a block diagram showing the coarse method by which the computer determines the ball center point when the ball passed trough one of the planes of the present invention.
Figure 12:
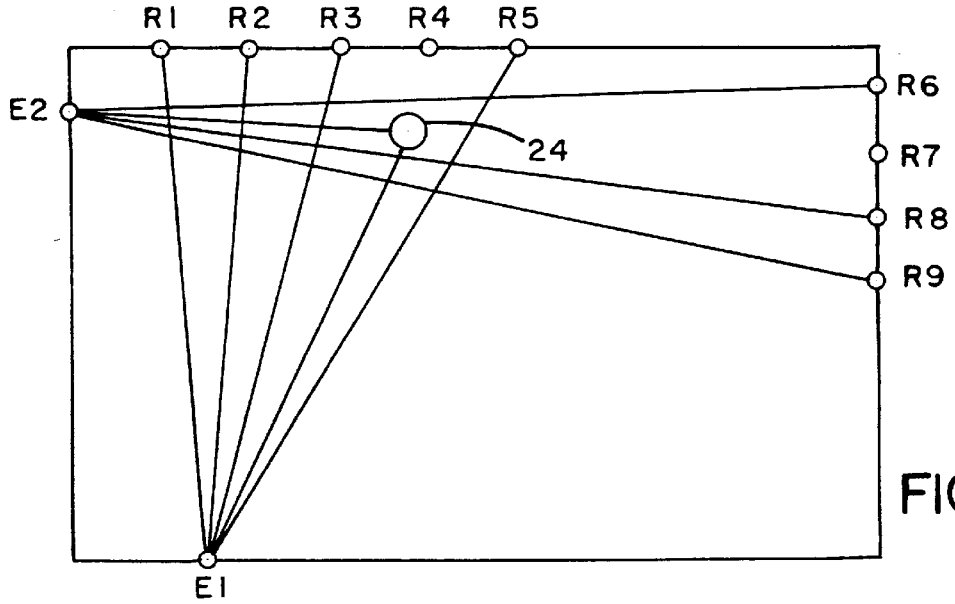
FIG. 12 is a schematic diagram showing several emitter-to-receiver bearing lines.

Now referring to FIG. 10, the details of the coarse determination of the center point of the ball 24 as it passed through a particular plane of receivers 24 are shown. Specifically, as indicated at block 298, the C30 board 126 identifies each set of juxtaposed lines. More specifically, the C30 board 126 identifies each set of detection lines from the overlay of the five center frames wherein successive receivers 54 indicated a detection. Thus, referring briefly to FIG. 12, receivers R1,R2 and R3 each indicated that the golf ball 24 was interposed between them and the emitter E1. The receiver R4 did not indicate a reception of a shadow and receiver R5 did indicate that it detected a shadow.

Accordingly, the set of juxtaposed lines for the emitter E1 that is identified by the C30 board 126 at block 298 includes the lines which extend from the emitter E1 to the receivers R1,R2 and R3. Next, at block 300, the C30 board 126 identifies the two outer lines for each set. In the example shown in FIG. 12, the two outer lines for the set discussed above are the lines which extend between emitter E1 and receivers R1 and R3.

Figure 11:
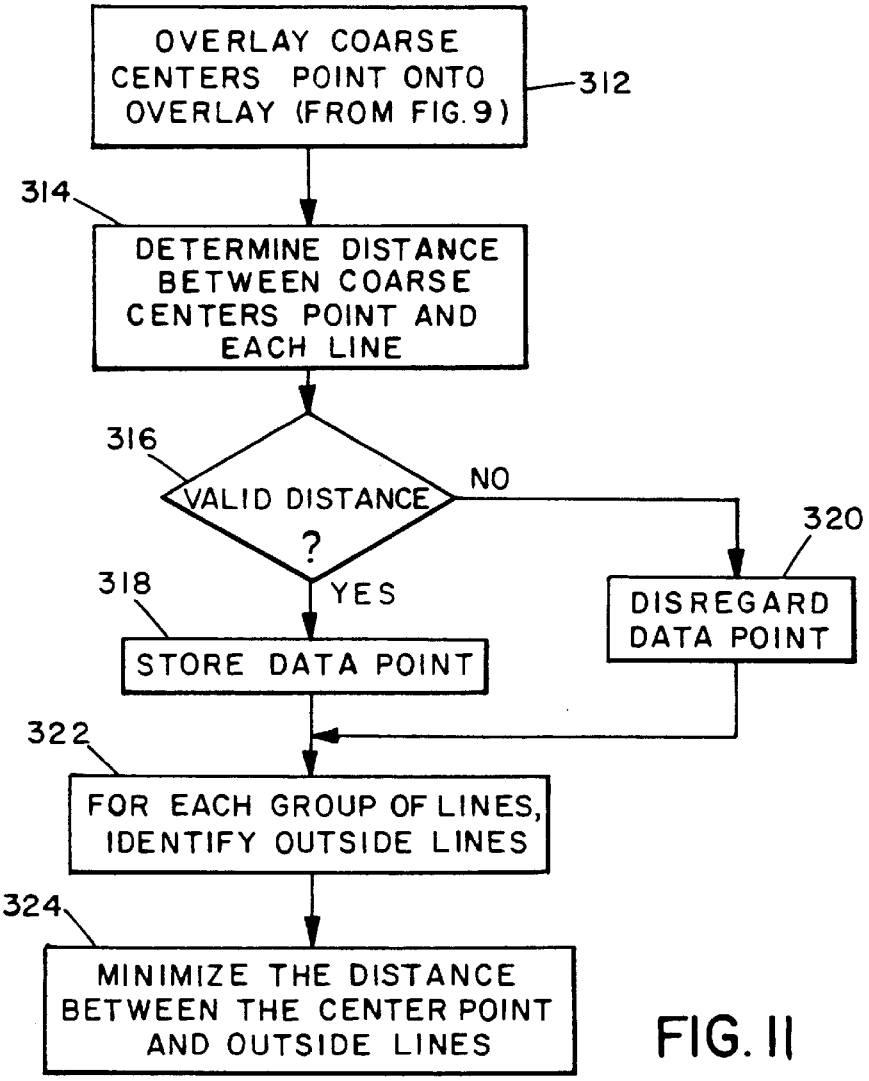
FIG. 11 is a block diagram showing the fine method by which the computer determines the ball center point when the ball passed through one of the planes of the present invention.

Then, at block 302, the C30 board 126 determines the line equation for the center line between the two outer lines, i.e., the line consisting of points that are equidistant from the lines R1-E1 and R3-E1. The center line for the set discussed above is the line R2-E1. The C30 board 126 then proceeds to block 304, wherein the C30 board 126 finds valid intersections of center lines. More particularly, FIG. 11 shows that there is a second group of juxtaposed lines, the lines E2-R6, E2-R7, E2-R8, the center line of which is the E2-R7 line.

The C30 board 126 next proceeds to block 304, wherein the C30 board determines, for each intersection of center lines, whether the intersection is valid. To be a valid intersection, the angle between the intersecting center lines under test must be greater than or equal to a predetermined angle. This is because the intersection between lines that are nearly parallel cannot be reliably positioned.

To determine whether the angle between the intersecting lines exceeds the predetermined value, the C30 board 126 uses standard trigonometry, i.e., the C30 board 126 computes the arctangent of the slope of each line (which equals the angle of each line relative to the Cartesian coordinate system defined by the array 50,52) and it takes the difference between the angles of each line. If the difference between the angles exceeds the predetermined value, the intersection is considered to be valid. In the preferred embodiment, the predetermined value is 200.

At block 304, the C30 board 126 not only determines valid intersections, but also determines the X-Y coordinates of each valid intersection. The C30 board 126 develops a table of the X-Y coordinates of the intersection.

To determine the X-Y coordinates of each intersection, the C30 board 126 uses standard geometric techniques. Specifically, the C30 board 126 uses the following equations:

$$Y_1=M_1X_1+B_1$$

$$Y_2=M_2X_2+B_2;$$

$$Y_1=Y_2$$

$$X_1=X_2$$

where $X_1$, $Y_1$ is the Cartesian coordinate of a point on the first line at the intersection, $X_2$, $Y_2$ is the Cartesian coordinate of a point on the second line at the intersection, $M_1$, $M_2$ are the slopes of the respective lines, and $B_1$, $B_2$ are Y intercepts of the respective lines.

The C30 board 126 sets $Y_1=Y_2$ and $X_1=X_2$, and is then able to algebraically solve for the X,Y intersection point of the two lines.

Next, the C30 board 126 proceeds to block 306 wherein for each intersection, the C30 board 126 determines, for each valid intersection, the distance from the intersection to all other valid intersections, and the C30 board 126 creates a table of these distances. To make this determination, the C30 board 126 uses the following equation:

$$\text{distance}=\sqrt{(X_2-X_1)^2+(Y_2-Y_1)^2}$$

From block 306, the C30 board 126 proceeds to decision block 308, wherein for each distance calculated at block 306 the C30 board 126 determines whether the distance is valid. In other words, the C30 board 126 determines whether each distance tested is within a predetermined value. In the preferred embodiment, the predetermined value is 1.4 inches.

The C30 board 126 then moves to block 310, wherein the C30 board 126 determines which intersection point has the most valid distances between all the other intersection points. The point with the most valid distance comparisons is set equal to the coarse center point of the ball 24.

Now referring to FIG. 11, the details of the refined center point adjust of block 286 in FIG. 9 can be seen. At block 312 of FIG. 11, the coarse center point of the ball 24 as determined from the subroutine of FIG. 10 is overlaid onto the bit-wise "or" overlay that was developed at block 280 in FIG. 9. Then, at block 314 the distance between the coarse center point and each line in the overlay is determined using well-known algebraic techniques. Each distance so determined is stored. Next, at decision block 316, each distance is compared to a predetermined distance. If any distance is greater than the predetermined distance, that distance is disregarded for further processing. In the preferred embodiment, the predetermined distance is 5 inches.

If the tested distance is less than the predetermined distance, the tested distance is found to be valid and the C30 board 126 proceeds to block 318, wherein the data point is stored. Otherwise, the C30 board 126 proceeds to block 320, wherein the C30 board 126 disregards the invalid data point. Next, at block 322, the C30 board 126 identifies the outside lines for each group of juxtaposed line. Thus, again referring to FIG. 11 as an example, the lines E1-R1 and E1-R3 and the lines E2-R6, E2-R8 would be considered.

The C30 board 126 then proceeds to block 324, wherein the C30 board 126 minimizes the maximum distance between the center point and each of the outside lines. To do this, the C30 board 126 moves the center point in incremental amounts toward the line furthest from the center point. After each incremental move, the C30 board 126 recalculates the distance between each of the outside lines and the center point and continues to move the center point the incremental amount toward whichever line is determined to be furthest away from the center point. In a preferred embodiment, the C30 board 26 undertakes one hundred such iterations and the incremental distance is five-thousandths of an inch 0.05).

At the end of the 100th iteration, the position of the center point is taken to be the position of the ball as it passed through that particular plane. In other words, the X-Y coordinates of the center point at the end of the 100 iterations is taken to be the X-Y coordinates which are used to indicate the position of the ball for calculation purposes in the overall logic diagram of FIG. 8A. One skilled in the technology will recognize that the steps in the accompanying flow diagrams can be implemented using a number of different compilers and/or programming languages.

Figure 14B:
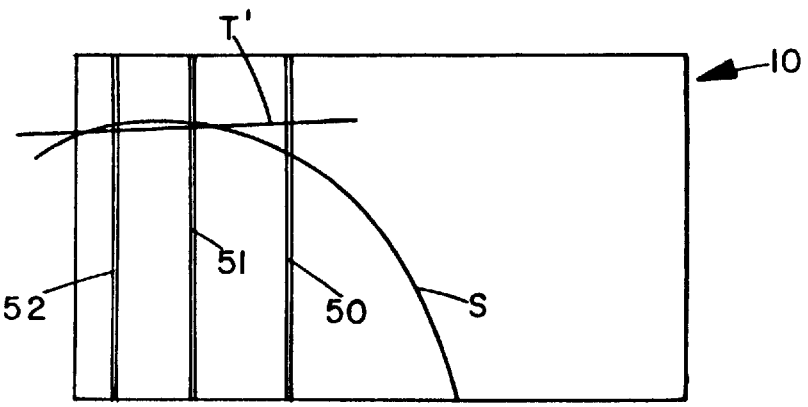
FIG. 14B is a schematic side elevational view of the simulator of FIGS. 1–11 illustrating a similar chip shot.
Figure 14A:
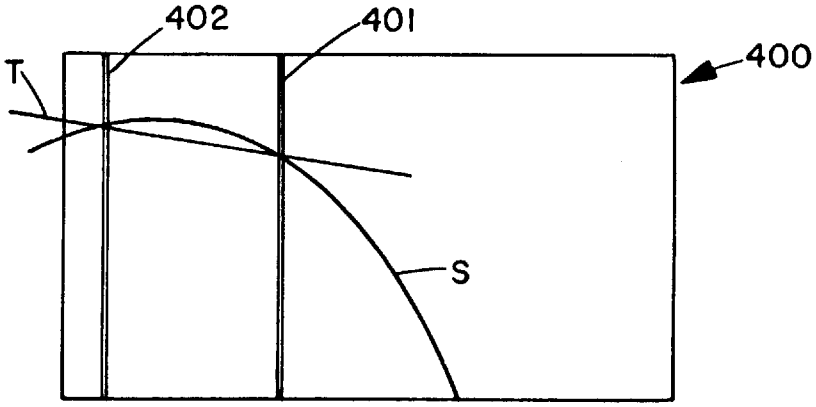
FIG. 14A PRIOR ART
FIG. 14A is a schematic side elevational view of a prior art simulator illustrating a short chip shot.

FIGS. 14A,B and 15A,B illustrate some of the advantages of the present system over systems having only two planes of detection. FIG. 14A illustrates a side view of a simulator 400 having two detector planes 401,402. A curved, short chip shot S intersects the two planes as indicated. The two data points will produce a trajectory T which is not an accurate representation of the actual ball direction. However, with the system 10 of this invention, the same shot S is detected to provide three successive data points, providing a much more accurate trajectory T'.

Figure 15A:
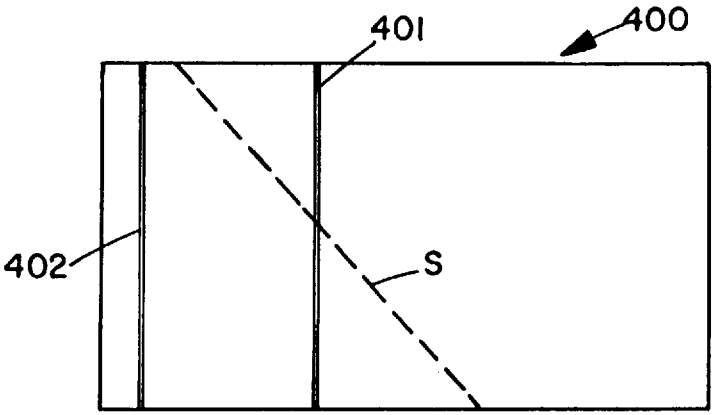
FIG. 15A PRIOR ART
FIG. 15A is a schematic side view similar to FIG. 14A illustrating a high chip shot.

The system of this invention is also more accurate in tracking high, hard chip shots or side "shanked" shots, which will not normally even be registered in the prior art system 400 having only two detector planes 401,402, as indicated in FIG. 15A. As illustrated in FIG. 15A, a high, hard chip shot S may pass through only the first plane 401 of sensors before hitting the ceiling of the enclosure. Similarly, a shot which is "shanked" sharply to one side may pass through only plane 401 before hitting a side wall. This does not permit the shot to be registered.

In contrast, with the system of this invention which has three detector planes 50,51 and 52, a high, hard chip shot S is almost certain to travel through at least the first and second planes, which is all that is needed to register the shot and determine its path. Similarly, side shanked shots will also travel through at least two planes, enabling these shots to be registered and displayed on the system as well, unlike the prior art arrangement.

The sports simulator system of this invention is more accurate and realistic than the prior art arrangements in other respects. The averaging of ball position between three detector planes results in around 10% improvement in accuracy of displayed ball position. Short putting shots are also more accurate with this system, which can register short putts of only 20 inches (i.e. the distance between the first two planes of detectors). In the prior art systems, the golfer had to putt the ball at least five feet before it would even register.

In summary, the invention described herein comprises a significant improvement over the prior art by providing a golf simulator achieves a more realistic and accurate simulation with less than half the error possible compared to the prior art. The invention also overcomes other long existent problems in the industry by providing a golf simulator that: (1) provides for a more accurate simulation by providing for the computing of putts or shots less than three feet and steep chip shots and (2) provides a more accurate simulation of ball movements into an illustrated environment by use of three vertically disposed arrays of sensors as opposed to two arrays.

The invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within the scope.

We claim:

1. A golf simulator, comprising:

a launch area from which a ball is accelerated;

a screen spaced at a predetermined distance from the launch area in a direction of travel of the ball;

first, second and third emitters for transmitting electromagnetic radiation, the emitters each being spaced from the launch area in the direction of travel of the ball;

a first array of receivers spaced at a predetermined distance from the launch area in the direction of travel of the ball and interposed between the launch area and the screen, at least some of the receivers in the first array being positioned to receive radiation from the first emitter and generating respective first signals in response thereto, the first array of receivers being arranged in a first plane;

a second array of receivers arranged in a second plane and interposed between the screen and the first array of receivers, at least some of the receivers in the second array being positioned to receive radiation from the second emitter and generating respective second signals in response thereto;

a third array of receivers arranged in a third plane and interposed between said second array of receivers and the screen, at least some of the receivers in the third array being positioned to receive radiation from the third emitter and generating respective third signals in response thereto;

each array of receivers being vertically disposed and perpendicular to the travel of a ball such that each array detects both a horizontal and vertical position of a ball driven from a tee to the screen through the planes established by each array; and a computer electrically connected to each array of receivers for receiving said first, second, and third signals from said receivers and computing first, second, and third positions of the ball detected by the first, second and third arrays of receivers, respectively;

said computer including timer means for determining a first time delay between receipt of said first and second signal, respectively, a second time delay between receipt of said second and third signal, respectively, and a third time delay between receipt of said first and third signal, respectively, and processing means for computing a first translational velocity from said first and second positions and said first time delay, a second translational velocity from said second and third positions and said second time delay, and a third translational velocity from said first and third positions and said third time delay, and computing an average translational velocity from said first, second and third translational velocities:

said computer further including means for computing an estimate of a rotational velocity of the ball from said third and from a fourth signal indicative of a position of the ball relative to the third array of receivers after the ball has rebounded from the screen; and means for computing the projected position of the ball on the screen based on said computed translational and rotational velocities, wherein said first, second, and third signals are combined to provide an estimate of a curvature of the ball travel path.

2. The simulator of claim 1, wherein the housing has an interior surface, and the first, second and third planes intersect the interior surface at intersections between each plane and the interior surface, the intersection of the first plane and interior surface establishing an edge of a first polygon, wherein the emitters in the first array are mounted on the interior surface of the housing along the edge of the first polygon, the intersection of the second plane and interior surface establishing an edge of a second polygon, wherein the emitters in the second array are mounted on the interior surface of the housing along the edge of the second polygon and the intersection of the third plane and interior surface establishing an edge of a third polygon, wherein the emitters in the third array are mounted on the interior surface of the housing along the edge of the third polygon.

3. The simulator of claim 2, wherein the first emitter is mounted on the interior surface of the housing and establishes a portion of the edge of the first polygon, the second emitter is mounted on the interior surface of the housing and establishes a portion of the edge of the second polygon and a third emitter is mounted on the interior surface of the housing and establishes a portion of the edge of the third polygon.

4. The simulator of claim 3, further comprising a first plurality of emitters mounted on the housing and positioned on the edge of the first polygon, a line of sight being established between at least one of the first emitters and at least one of the receivers in the first array, a second plurality of emitters mounted on the housing and positioned on the edge of the second polygon, a line of sight being established between the second emitter and at least one of the receivers in the second array, a third plurality of emitters mounted on the housing and positioned on the edge of the third polygon, a line of sight being established between the third emitter and at least one of the receivers in the third array.

5. The simulator of claim 4, wherein the emitters in each plurality are electrically connected to the computer, and the computer causes the emitters to sequentially emit infrared radiation pulses.

6. The simulator of claim 5, wherein the ball passing through the edge of a polygon interrupts the line of sight between at least one of the emitters and at least one of the receivers in the respective array to cause the receiver to generate a signal representative of a passage of the ball.

7. The simulator of claim 6, wherein the computer causes emitters in the second polygon to sequentially emit infrared radiation pulses in response to a ball interrupt in the first polygon and the emitters in the third polygon to sequentially emit infrared radiation pulses in response to a ball interrupt in the second polygon.

8. The simulator of claim 7, further comprising a video projector electrically connected to the computer, wherein the computer generates a signal representative of a curved trajectory of the ball, whereby a video image of the ball as the ball would have appeared, had the ball not encountered the screen, is displayed on the screen.

9. A golf simulator, comprising:

a computer;

a projector electrically connected to the computer;

a housing having a tee area from which a golf ball is accelerated;

a screen attached to the housing and distanced from the tee area in a direction of motion of the golf ball for preventing the golf ball from passing beyond the screen, wherein the computer generates a first and second control signal representative of translational velocity and a third control signal representative of rotational velocity of the golf ball, and wherein the computer causes the projector to project a video image of the golf ball as the ball would have appeared, had the ball not encountered the screen, based on the first, second and third control signals; and means for generating a plurality of sensing signals in response to motion of the golf ball though the housing, the generating means comprising first, second and third arrays of motion sensors arranged in respective first, second and third planes each spaced from the tee area within the housing, the planes being disposed between the tee area and the screen wherein the first, second and third array of motion sensors produce first, second and third sensing signals indicative of a position of the golf ball in the first, second and third planes respectively as the golf ball travels toward the screen and a fourth sensing signal indicative of a position of the golf ball in the third plane after the golf ball rebounds from the screen, wherein the computer uses the third and fourth sensing signals to produce the third control signal representative of the rotational velocity of the golf ball, and wherein said first, second and third sensing signals are combined to provide an estimate of the translational velocity and direction of travel of the ball.

10. The simulator of claim 9, further comprising:

a first plurality of infrared radiation emitters mounted on the housing and establishing the first plane, the first plane intersecting the housing to establish an edge of a first polygon, the emitters being positioned on the edge of the first polygon;

a second plurality of infrared radiation emitters mounted on the housing and establishing the second plane, the second plane intersecting the housing to establish an edge of a second polygon; and a third plurality of infrared radiation emitters mounted on the housing and establishing the third plane, the third plane intersecting the housing to establish an edge of a third polygon.

11. The simulator of claim 10, further comprising:

a first array of receivers positioned on the edge of the first polygon, at least some of the receivers in the first array being positioned to receive the infrared radiation from at least one emitter in the first plurality of emitters and generating respective signals in response thereto;

a second array of receivers positioned on the edge of the second polygon, at least some of the receivers in the second array being positioned to receive the infrared radiation from at least one emitter in the second plurality of emitters and generating respective signals in response thereto; and a third array of receivers positioned on the edge of the third polygon, at least some of the receivers in the third array being positioned to receive the infrared radiation from at least one emitter in the third plurality of emitters and generating respective signals in response thereto.

12. The simulator of claim 11, wherein emitters in each plurality of emitters are electrically connected to the computer, and the computer causes the emitters to sequentially emit infrared radiation pulses.

13. The simulator of claim 11, wherein a golf ball passing through the edge of a polygon interrupts a line of sight between at least one of the emitters and at least one of the receivers in the respective array to cause the receiver to generate a signal representative of a passage of the ball.

14. The simulator of claim 13, wherein the computer causes emitters in the second polygon to sequentially emit infrared radiation pulses in response to a ball interrupt in the first polygon and the emitters in the third polygon to sequentially emit infrared radiation pulses in response to a ball interrupt in the second polygon.

15. The simulator of claim 9, wherein the spacing between the first and second planes is in a range from 21 inches to 25 inches.

16. The simulator of claim 15, wherein the spacing between the second and third planes is in the range from 23 inches to 27 inches.

17. The simulator of claim 15, wherein the spacing between the tee area and the first plane is in the range from 60 inches to 70 inches.

18. The simulator of claim 16, wherein the spacing between the third plane and the screen is in the range from 7 inches to 9 inches.

19. The simulator of claim 9, wherein the screen has four perpendicular edges defining a rectangular outer periphery, an elongated sleeve extending along each edge of the screen, a stiffener member extending through each sleeve, and spaced fastener means for securing each stiffener member to the housing.

20. The simulator of claim 19, wherein the screen has a series of cut-outs along each edge, exposed portions of said stiffener members extending across each cut-out, the housing having a peripheral support frame surrounding said frame, and the fastener means comprising cords securing each exposed portion of each stiffener member to said support frame.

21. A method of projecting a video image of a golf ball on a screen illustrating how the golf ball would have moved, had the golf ball not encountered the screen, comprising the steps of:

accelerating a golf ball from a tee area towards a screen;

sensing passage of the golf ball through a first plane located between the tee area and the screen and generating a first signal in response thereto;

sensing passage of the golf ball through a second plane located between the first plane and the screen and generating a second signal in response thereto;

sensing passage of the golf ball through a third plane located between the second plane and the screen and generating a third signal in response thereto;

sensing passage of the golf ball back through the third plane after the golf ball has struck and rebounded from the screen and generating a fourth signal in response thereto;

detecting a first time delay between a time of passage of the ball through the first and second planes, a second time delay between a time of passage of the ball through the second and third planes, and a third time delay between a time of passage of the ball through the first and third planes, computing a first translational velocity based on said first and second signals and said first time delay, computing a second translational velocity based on said second and third signals and said second time delay, computing a third translational velocity based on said first and third signals and said third time delay, and computing an average translational velocity from said first, second and third translational velocities;

computing a position of the golf ball as the golf ball strikes the screen from said first, second and third signals;

computing a rotational velocity of the golf ball at the screen from said third and fourth signals; and projecting a video image of the golf ball on the screen in accordance with the computed translational and rotational velocities.

* * * * *